US007464655B2

(12) United States Patent
Anthony et al.

(10) Patent No.: US 7,464,655 B2
(45) Date of Patent: Dec. 16, 2008

(54) APPARATUS FOR MANUFACTURING FABRIC FOR COVERINGS FOR ARCHITECTURAL OPENINGS

(75) Inventors: James M. Anthony, Denver, CO (US); Kevin M. Dann, Denver, CO (US); Joseph E. Kovach, Brighton, CO (US); Richard E. Rossi, Thornton, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 11/759,675

(22) Filed: Jun. 7, 2007

(65) Prior Publication Data

US 2007/0221109 A1 Sep. 27, 2007

Related U.S. Application Data

(63) Continuation-in-part of application No. 11/615,835, filed on Dec. 22, 2006.

(60) Provisional application No. 60/758,494, filed on Jan. 12, 2006.

(51) Int. Cl.
*D05B 35/08* (2006.01)
*D05B 33/00* (2006.01)

(52) U.S. Cl. ..... 112/470.12; 112/144

(58) Field of Classification Search ..... 112/104, 112/470.12, 470.33, 144–147, 303, 311, 112/217.2; 223/38; 29/24.5
See application file for complete search history.

(56) References Cited

U.S. PATENT DOCUMENTS 263,778 A * 9/1882 Fisher et al. ..... 112/146
1,883,177 A * 10/1932 Weis ..... 112/470.12
1,939,617 A * 12/1933 Bernhard ..... 16/87.2
3,874,311 A * 4/1975 Kenney ..... 112/470.12
3,986,647 A 10/1976 Kendall
4,542,602 A * 9/1985 Hoverson ..... 38/102.1
4,945,969 A * 8/1990 Schnebly et al. ..... 160/84.02
5,127,138 A * 7/1992 Lim ..... 29/24.5
5,313,998 A * 5/1994 Colson et al. ..... 160/84.02
5,769,015 A 6/1998 Kato
5,897,731 A * 4/1999 Colson et al. ..... 156/197
5,996,198 A 12/1999 Wang et al.

(Continued)

FOREIGN PATENT DOCUMENTS

CH 534 243 2/1973

(Continued)

*Primary Examiner*—Ismael Izaguirre
(74) *Attorney, Agent, or Firm*—Dorsey & Whitney LLP

(57) ABSTRACT

An apparatus for forming fabrics for use, by way of example, in coverings for architectural openings includes a system for handling single or multi-layered fabrics by suspending the fabric from a lift tower, threading the fabric through various clamp systems within a housing for the apparatus, and subsequently forming horizontal rows of hobbles, tunnels, and/or attached rings by gripping and releasing the fabric with a vacuum clamp, upper and lower clamps, and a tucker blade clamp while a reciprocating tucker blade forms horizontal tucks in the fabric. Hobbles can also be formed in one layer of the fabric through use of the vacuum clamp which gathers a portion of one layer of the fabric while the other layer is handled differently. In doing so, hobbles are formed between tucks in the fabric with the hobbles establishing a fabric resembling a Roman shade.

12 Claims, 41 Drawing Sheets

U.S. PATENT DOCUMENTS 6,530,335 B1 3/2003 Halfmann et al.

FOREIGN PATENT DOCUMENTS

JP 07 275544 A 10/1995
JP 10 137476 A 5/1998
JP 2000 303348 A 10/2000
NL 1 004 021 C2 3/1998
NL 1 006 408 C2 12/1998
WO WO 90/04079 A1 4/1990

* cited by examiner

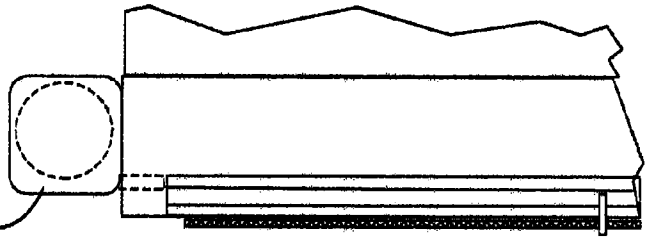
Fig. 33
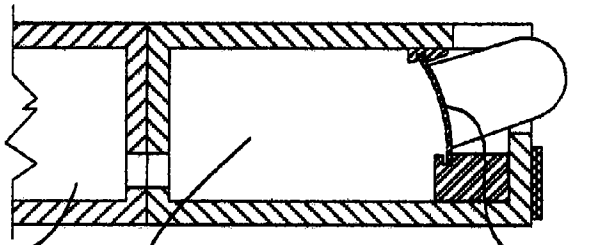
Fig. 34
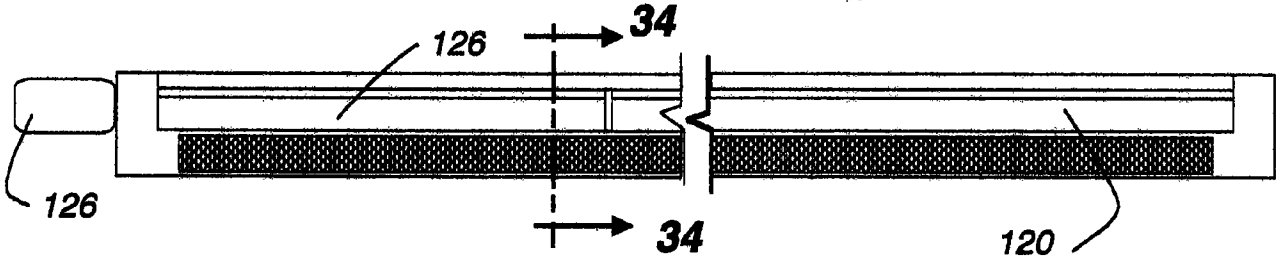
Fig. 32
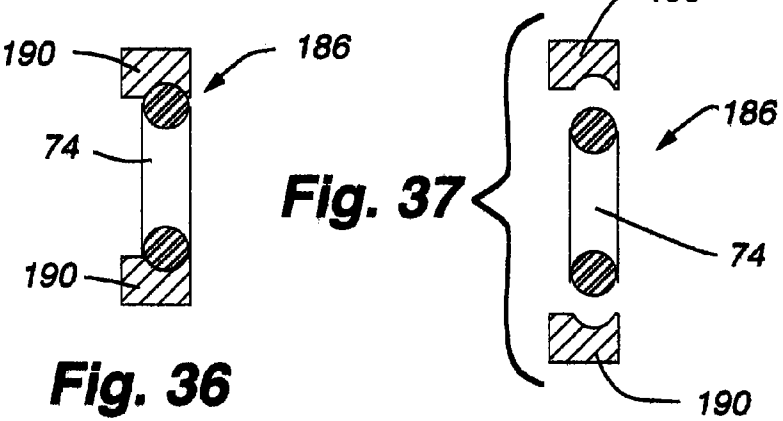
Fig. 37
Fig. 36
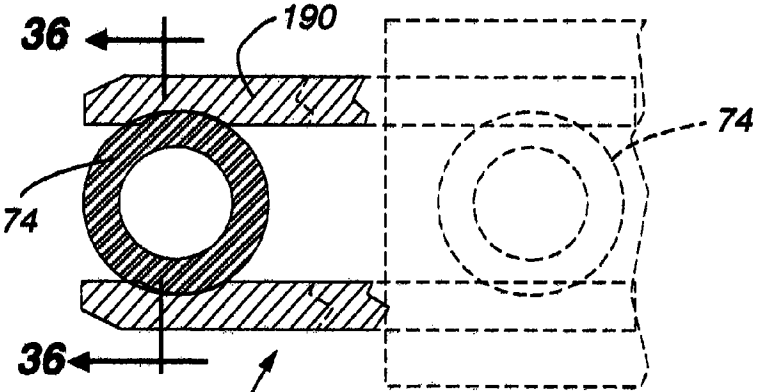
Fig. 35

APPARATUS FOR MANUFACTURING FABRIC FOR COVERINGS FOR ARCHITECTURAL OPENINGS

CROSS REFERENCE TO RELATED APPLICATIONS

This application is a continuation-in-part of U.S. application Ser. No. 11/615,835 filed on Dec. 22, 2006, and is also related to U.S. application Ser. No. 11/615,854 filed on Dec. 22, 2006, which applications claim priority to U.S. provisional application No. 60/758,494 filed on Jan. 12, 2006. These applications are hereby incorporated by reference as if fully disclosed herein.

BACKGROUND OF THE INVENTION

1. Field of the Invention

The present invention relates generally to an apparatus for sewing fabrics and attaching rings to fabrics wherein the fabrics are, for example, usable in coverings for architectural openings and more particularly to an apparatus that takes a single or multi-ply sheet of material and either forms hems, tunnels, hobbles, and/or attaches rings to the material so it is suitable for connection to a control system for a covering for an architectural opening.

2. Description of the Relevant Art

While early forms of coverings for architectural openings consisted principally of draped fabrics or fabrics which were gathered along a top edge so as to form drapery, in recent years designer window coverings have taken on many numerous forms. Included in those forms are coverings that utilize fabric that can be raised or lowered and gathered in the process wherein rings or other guide systems are incorporated into the fabric to slidably confine lift cords or the like. Further, in Roman shade type products, horizontal droops in the fabric, otherwise referred to as hobbles, might be formed in the fabric for aesthetics.

While sewing machines have been used to form hobbles or attach rings to fabric, it was all hand operated with an operator literally moving and shifting the fabric as it was passed through an appropriate sewing machine for either stitching the fabric to provide hems or tunnels across the width of the fabric or to attach suitable guide rings.

There has, accordingly, been a need in the industry for automating the fabrication of fabric for use in coverings for architectural openings or in the use of fabrics that might have other uses wherein stitching, hobbles, the attachment of rings, or the like, is a requisite.

SUMMARY OF THE INVENTION

The apparatus of the present invention includes a vertically oriented and adjustable lift rack to which a top edge of a fabric material can be secured with the remainder of the material hanging by gravity through a lower housing where clamps are utilized to control the fabric during operations thereon.

A sewing carriage including a pair of tandem sewing machines having different capabilities are mounted together for movement in unison in a reciprocal path back and forth across the width of the fabric. One sewing machine is adapted to stitch the fabric from one side edge to the other while the other sewing machine is adapted to attach horizontally spaced rings to the fabric in a return movement of the sewing machines across the width of the fabric. When stitching the fabric, which might be a dual layer or dual panel fabric, the layers can be handled separately so that one layer might have hobbles formed therein while the other layer remains flat. Tunnels are also defined by the stitching in which rigidifying bars might be inserted. When forming tunnels and/or attaching guide rings to the fabric, a tucker blade is utilized to advance a horizontal section of the fabric into a position for engagement by the sewing machines with the tucker blade being retractable before stitching or the attachment of rings to the fabric. A vacuum chamber is also utilized in one embodiment to gather a horizontal segment of one layer of the fabric to form a hobble while the other layer is unaffected by the vacuum so that both layers can be stitched together with a hobble being formed in one layer. In a second embodiment, the hobble is formed by manipulating the layers with the lift rack.

A lower releasable clamp in the first embodiment is positioned beneath the sewing machines and has three distinct positions with an open position permitting the free passage of at least a layer of material therethrough, a soft clamp position providing some resistance to movement of the fabric with brushes for removing lint wrinkles or the like from the fabric and a hard clamp position where the fabric can be positively gripped during a sewing operation.

When the sewing machines have completed one operation of stitching, forming hobbles and/or sewing rings to the fabric, they are repositioned at a home position so the fabric can be elevated or dropped a predetermined amount, depending on the embodiment, for a repeat of the afore-described operation whereby vertically adjacent rows of hobbles, tunnels, rings, or the like, are formed in the fabric until the entire fabric has been treated. It can then be removed from the lift rack and is suitable for attachment to a control system for a covering for an architectural opening in which the fabric forms an integral part.

Other aspects, features, and details of the present invention can be more completely understood by reference to the following detailed description of the preferred embodiment, taken in conjunction with the drawings and from the appended claims.

BRIEF DESCRIPTION OF THE DRAWINGS

FIG. 32 is a fragmentary section taken along line 32-32 of FIG. 14.

FIG. 33 is a top plan view of the portion of the apparatus shown in FIG. 32.

FIG. 34 is an enlarged fragmentary section taken along line 34-34 of FIG. 32.

FIG. 35 is a fragmentary section taken along line 35-35 of FIG. 26.

FIG. 36 is a section taken along line 36-36 of FIG. 35.

FIG. 37 is a section similar to FIG. 36 showing the ring clamp in an open position.

DESCRIPTION OF THE PREFERRED EMBODIMENT

Figures 1, 2:
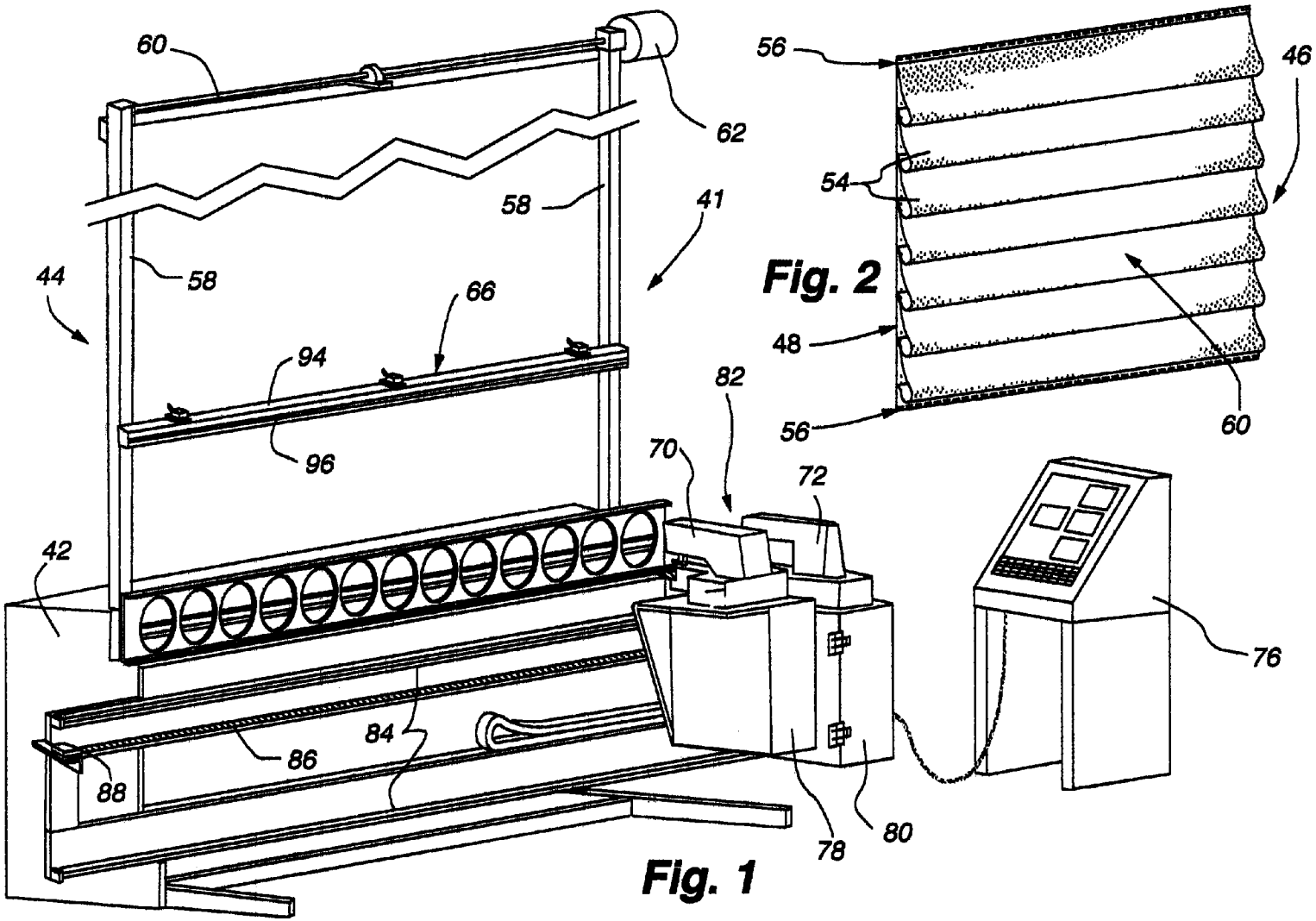
FIG. 1 is a diagrammatic fragmentary isometric of the apparatus of the present invention.
FIG. 2 is a front isometric of a fabric formed from the apparatus of FIG. 1.
Figures 3, 4:
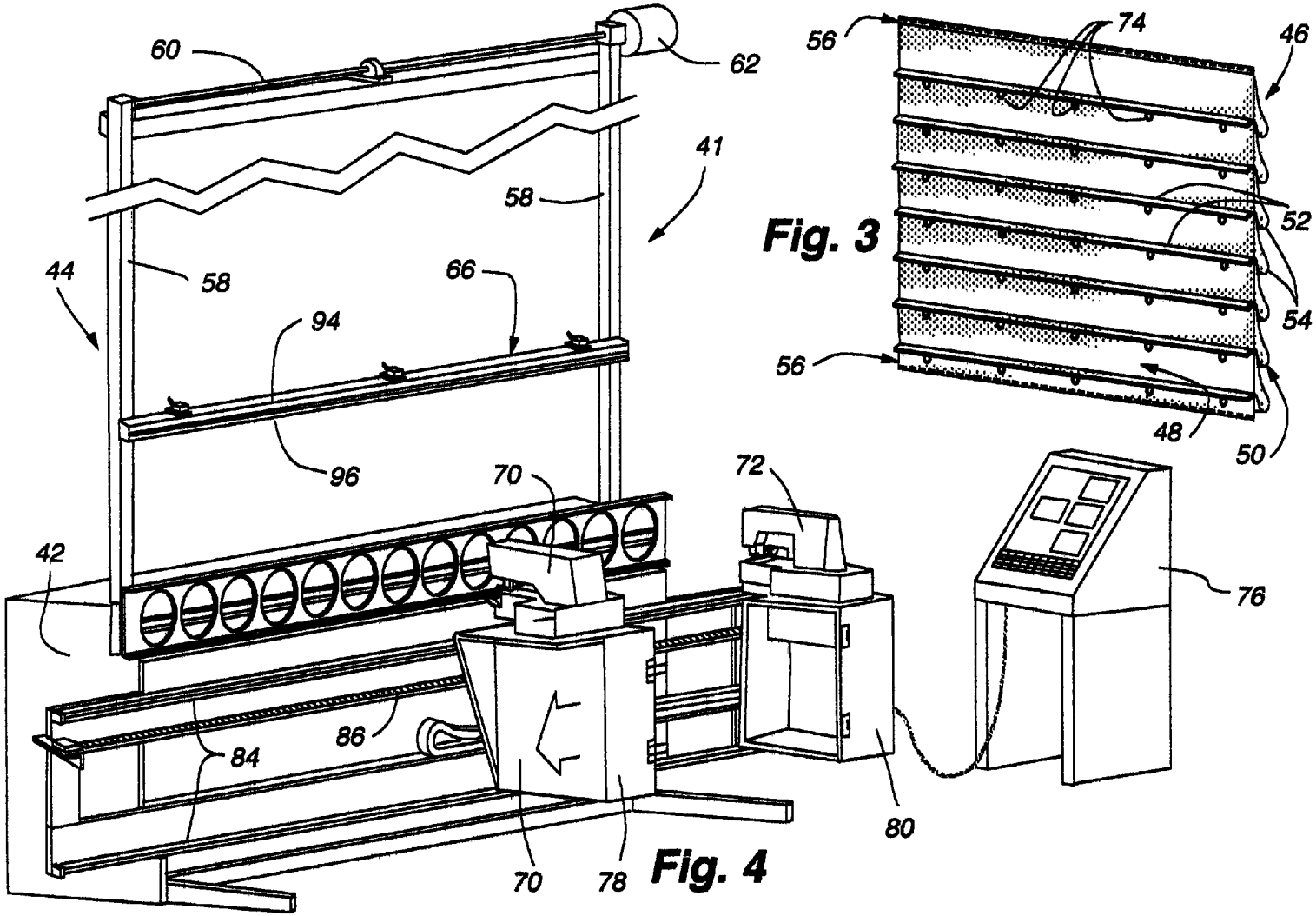
FIG. 3 is a rear isometric of the fabric shown in FIG. 2.
FIG. 4 is an isometric similar to FIG. 1 showing the sewing machines separated as they might be for maintenance purposes.

Looking first at a first embodiment of the invention shown in FIGS. 1-40, the apparatus 41 (FIG. 1) can be seen to include a housing 42 on which a lift rack 44 is mounted. As will be described hereafter, the housing includes various components of the apparatus for handling fabric that is being treated while the lift rack supports an upper edge of the fabric and is vertically movable to raise or lower the fabric into or out of the housing. As seen in FIGS. 2 and 3, a completed fabric 46 which could be formed with the apparatus of the present invention is illustrated. It is shown to include a backing or rear layer 48 and a front layer 50 with the front layer secured to the backing layer along horizontal vertically spaced tucks 52 in the fabric in a manner whereby a plurality of vertically aligned horizontally disposed hobbles or droops 54 in the fabric are formed so the fabric resembles a Roman shade. A tunnel 56 can be formed along the top and bottom edges of the fabric for receipt of a stiffening bar (not seen) with the tunnel possibly being formed from two horizontal lines of stitching that are vertically spaced or by folding the edge and with one stitch forming a hemmed edge. The top tunnel would typically be formed in the fabric before the fabric is treated with the apparatus of the present invention. The top edge of the fabric is then supported in the lift rack 44 so the fabric is properly disposed for processing within the apparatus.

The lift rack 44 consists of a pair of horizontally spaced vertically extending support towers 58 that are interconnected at their top ends to support a horizontal drive shaft 60 and a motor 62 for reversibly rotating the drive shaft. The lift towers have lift cords (not seen) disposed therein with the lift cords being operably connected to opposite ends of a vertically adjustable horizontally extending transverse lift bar 66 which is referred to hereafter as an upper clamp. Reversible rotation of the drive shaft raises or lowers the upper clamp for purposes to be described hereafter.

The housing 42 includes a number of operative components which will be described hereafter and which are adapted to grip and manipulate a virgin fabric 68 (FIGS. 5-9) to properly position the fabric so that one or both of a pair of sewing machines 70 and 72 mounted on the housing for reciprocal horizontal translating movement can direct sewing operations to the fabric in a preselected manner.

One of the sewing machines 70 is provided to stitch horizontal lines in the fabric while the other 72 is provided to attach guide rings 74 (FIGS. 3, 21, 22 and 25-28) commonly found in certain coverings for architectural openings such as Roman Shades. Both sewing machines are conventional for their intended purpose and will therefore only be described broadly hereafter with specific regard to their operation and relationship to the fabric being treated.

The apparatus is designed to treat virgin fabric 68 in several different ways so the fabric can be formed with a plurality of hobbles 54, a plurality of guide rings 74 attached thereto, a plurality of horizontal tunnels 56 on the front or rear of the fabric, and various combinations of the above. The treatments are accomplished in one continuous operation of the apparatus.

The apparatus is controlled through a conventional computer control module 76 that energizes various pumps, motors, and pneumatic pistons for achieving the various operations performed by the apparatus on the fabric. A detailed description of the software for driving the control module will not be described herein but suffice it to say the various operating mechanisms in the apparatus are controlled from the module and with an appropriate computer-controlled system.

The sewing machines 70 and 72 are mounted on two interconnected halves 78 and 80, respectively, of a sewing machine carriage 82 with the halves typically being interconnected so the sewing machines move in unison but can be separated as shown in FIG. 4 for individual maintenance of the machines. One sewing machine 70 in the preferred embodiment is a walking foot/needle feed lock stitch machine used to stitch the fabric in a manner to become clear hereafter and might be for example a Seiko SSH-88LDC-DTFL machine manufactured by Seiko of Japan. The other machine 72 in the preferred embodiment is a conventional button sewing machine which might be for example a Pfaff 3307 button or ring-stitching machine manufactured by Pfaff of Belgium. The ring-stitching machine, while normally being used for sewing buttons, can sew rings of the type used as guide rings 74 on fabrics for coverings for architectural openings wherein the rings are retained in a hopper (not seen) on the machine and fed to the sewing head where they are connected to the fabric. It is not important which of the two sewing machines is on the right or on the left as they both move in unison across the entire width of the fabric being treated.

The interconnected halves 78 and 80 of the carriage 82 for the sewing machines 70 and 72 are mounted on a horizontally disposed linear bearing or guide track 84 for reciprocal horizontal movement as the carriage, with the sewing machines thereon, is reversibly translated across the width of the housing 42. The sewing machines on the carriage are typically stationed at a home position at the right end of the apparatus as viewed in FIG. 1 and during one operation on a virgin fabric 68, the carriage translates to the left for a stitching operation and then back to the right for a ring attaching operation where it remains in its home position until another row of operations is performed on the fabric. Movement of the carriage is accomplished with a tensioned timing belt 86 as best appreciated by reference to FIGS. 1 and 38-40, which is anchored to the housing 42 at opposite ends with fixed brackets 88. One of the carriage halves 78 has a motor (not seen) that reversibly drives a gear wheel 90 in operative engagement with the timing belt with the timing belt passing across idler pulleys 92 on opposite sides of the driven gear wheel. It can therefore be appreciated that rotation of the gear wheel in one direction causes the carriage 82 to translate linearly in one direction across the apparatus and rotation of the gear wheel in the opposite direction causes the carriage to translate linearly in the opposite direction so it can be moved from one side of the apparatus 41 to the other at predetermined and/or intermittent speeds.

FIGS. 5-12 illustrate diagrammatically the various steps that can be applied to a virgin fabric 68 with the apparatus 41 of the present invention in forming a completed fabric 46 of the type illustrated in FIGS. 2 and 3. The completed fabric in the example shown includes a plurality of horizontal hobbles or loops 54 formed in vertically adjacent rows on the front layer of the fabric (FIG. 2) and a plurality of horizontally extending vertically spaced tucks 52 having horizontally spaced guide rings 74 secured thereto formed on the rear layer 48 of the fabric as seen in FIG. 3. Looking first at FIG. 5, a virgin fabric consisting of two layers of sheet material that have been pretreated to form a tunnel 56 along a top edge thereof with a rigidifying slat (not seen) possibly inserted therein is clamped to the upper clamp 66. The upper clamp includes a pair of horizontal bars 94 and 96 that can be clamped together or released. In the released position, the top edge of the virgin fabric 68 can be inserted between the bars and in the clamped position releasably secured between the bars. While the fabric could be positioned at any place across the width of the upper clamp, if in fact the fabric were narrower than the width of the lift rack 44 as illustrated, it is preferably positioned along one side edge (illustrated as the right side edge) for a purpose to be more clear hereafter.

Figure 6:
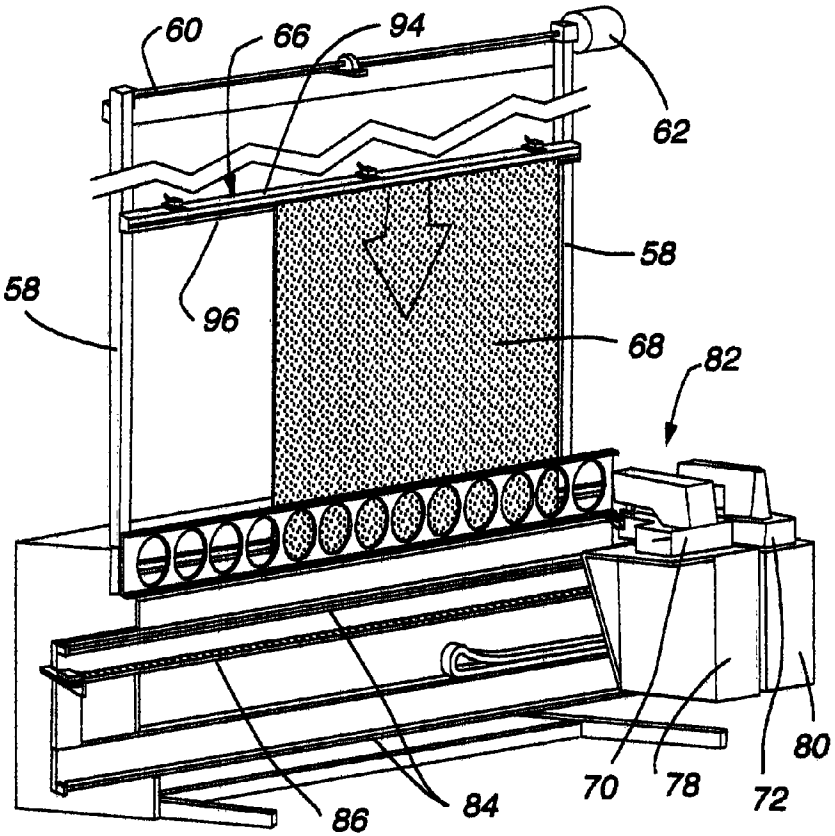
FIG. 6 is a diagrammatic isometric similar to FIG. 5 showing a second step in the treatment of a fabric.
Figure 10:
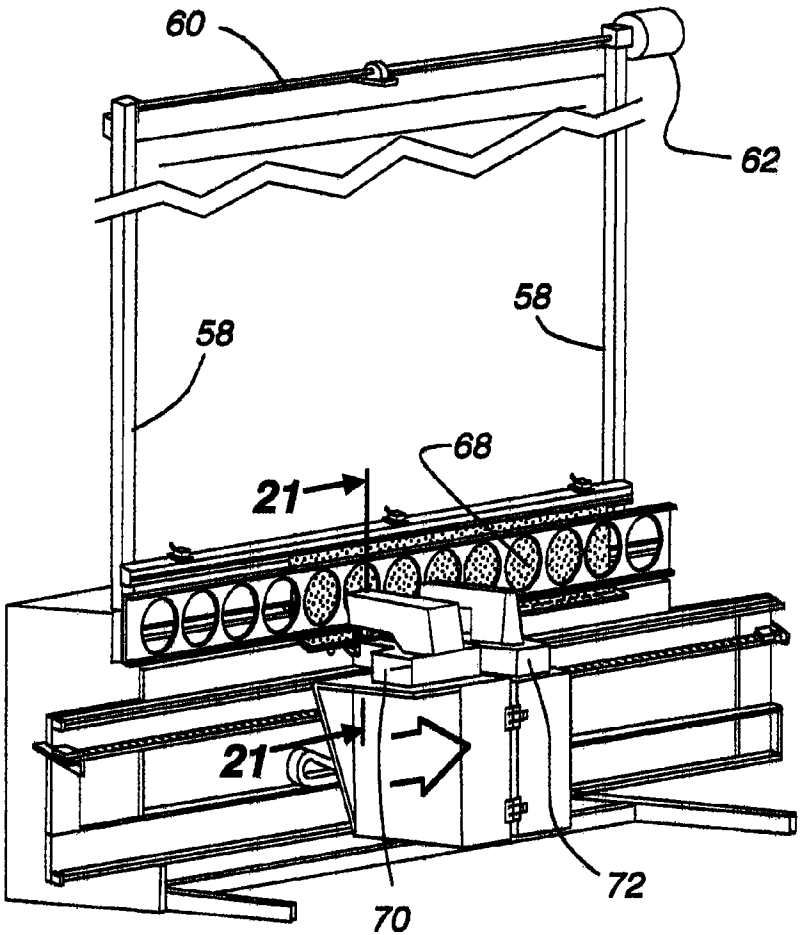
FIG. 10 is a diagrammatic isometric similar to FIG. 9 showing a sixth step in the treatment of a fabric.
Figure 9:
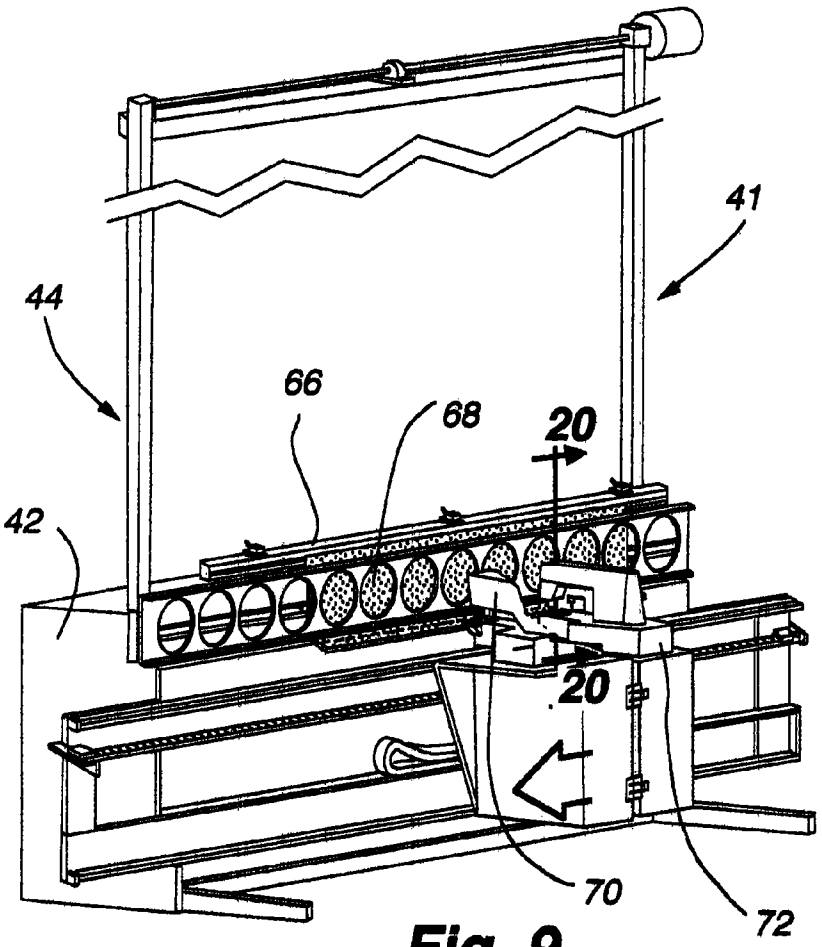
FIG. 9 is a diagrammatic isometric similar to FIG. 8 showing a fifth step in the treatment of a fabric.
Figure 12:
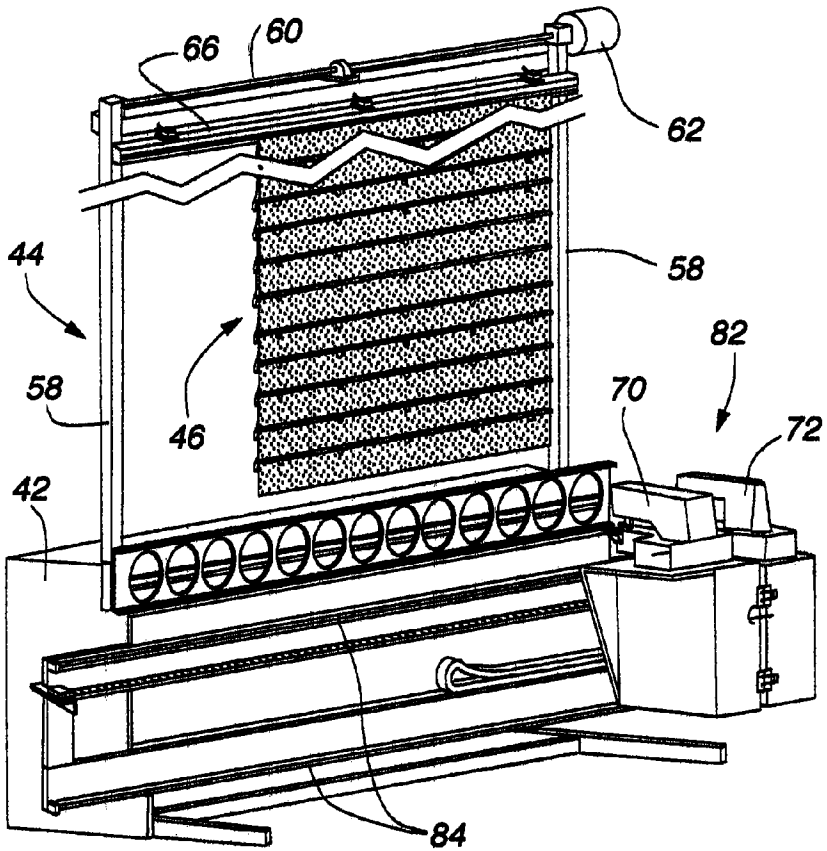
FIG. 12 is a diagrammatic isometric similar to FIG. 11 showing an eighth step in the treatment of a fabric.
Figure 11:
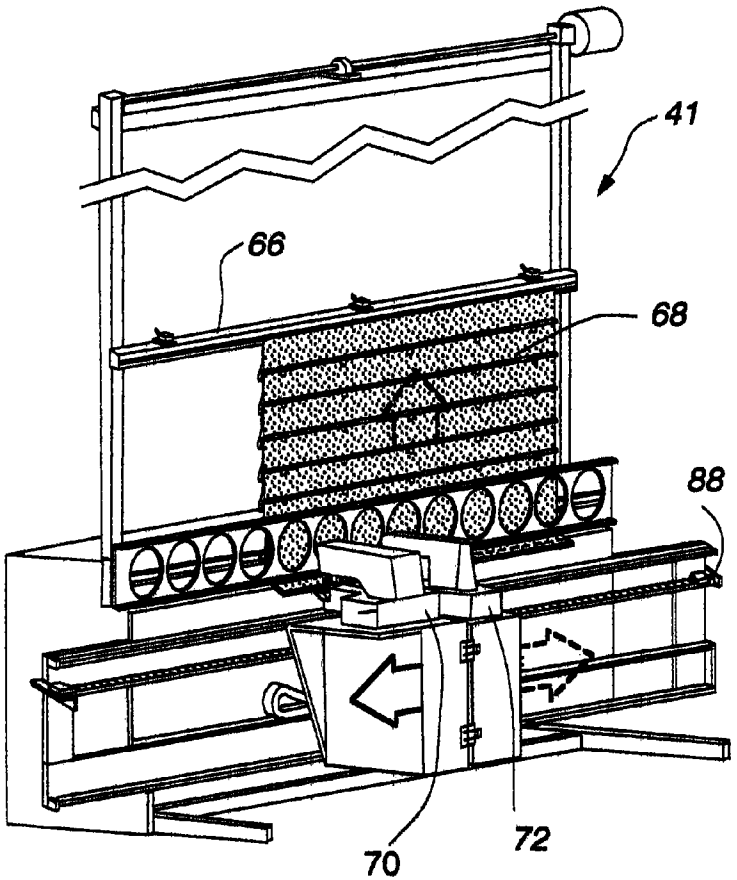
FIG. 11 is a diagrammatic isometric similar to FIG. 10 showing a seventh step in the treatment of a fabric.
Figure 18:
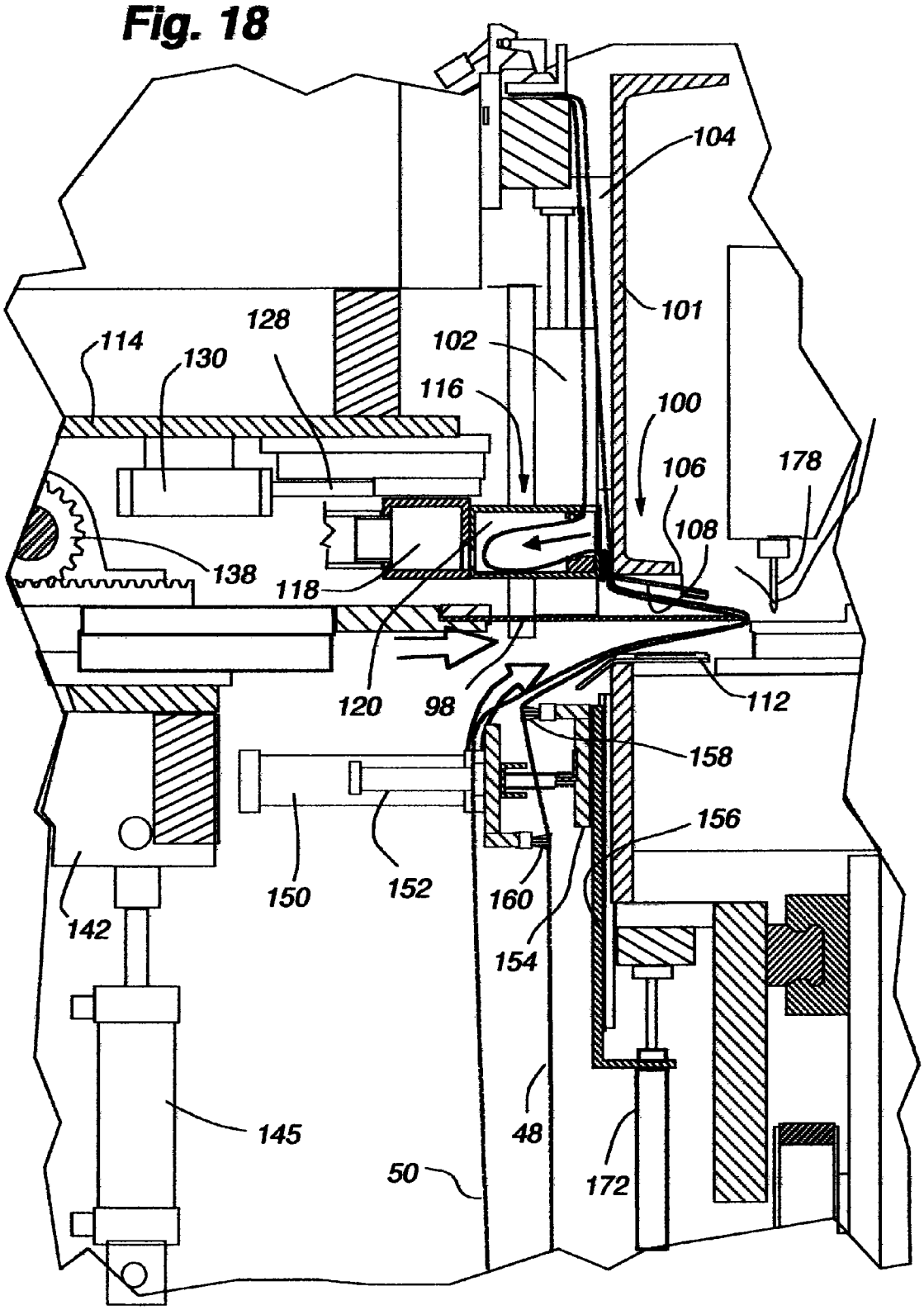
FIG. 18 is an enlarged diagrammatic section taken along line 18-18 of FIG. 8.

After the virgin fabric 68 is secured to the upper clamp 66, the upper clamp is elevated with the motor 62 and drive shaft 60 to the position of FIG. 6 so the fabric is substantially vertically suspended with its lower edge at the top of the housing 42. The upper clamp is then lowered and depending upon the operations to be applied to the virgin fabric, the two layers of the fabric can be maintained together or separated so as to straddle various components within the housing. Once the layers of the fabric are positioned for the operations to be applied thereto within the housing, the upper clamp is lowered to an initial operative position shown in FIG. 7. Thereafter, a hobble 54 is formed in the front layer 50 and a reciprocating horizontally disposed tucker blade 98, which will be described in more detail later, which is normally in a retracted position adjacent to the front layer of the fabric, is advanced as shown in FIG. 18 to form a tuck 52 off the rear of the fabric on which the sewing machines 70 and 72 can operate. The tuck in the fabric is then gripped with a tuck clamp 100 (to be described later) and the tucker blade retracted so a first operation of the sewing machines as shown in FIG. 9 can be initiated with the sewing machines translating from their home position at the right end of the apparatus 41 to the left end of the apparatus. As shown in FIG. 10, a subsequent pass of the sewing machines from the left end of the apparatus back to their home position allows one of the sewing machines to perform a separate operation. For example, in the fabric 46 illustrated in FIGS. 2 and 3 where both hobbles 54 and guide rings 74 are applied to the fabric, the movement from the home position to the left as shown in FIG. 9 would be used to form a horizontal stitch with one of the sewing machines 70 along the tuck to hold the two layers of material in the tuck together and the reverse movement of the sewing carriage 82, as shown in FIG. 10, would be used for attaching the guide rings with the other sewing machine 72 along the edge of the tuck. After one such operation, one row of a tunnel 56, defined by a tuck, with its associated guide rings is completed along with a hobble and at that time, the upper clamp 66 is elevated a predetermined distance, i.e. the height of a hobble, and the operation is repeated. By repeating the operation a new row is formed and the upper clamp is again elevated a predetermined amount as shown in FIG. 11 until the entire fabric 46 has been completed as illustrated in FIG. 12.

Figure 5:
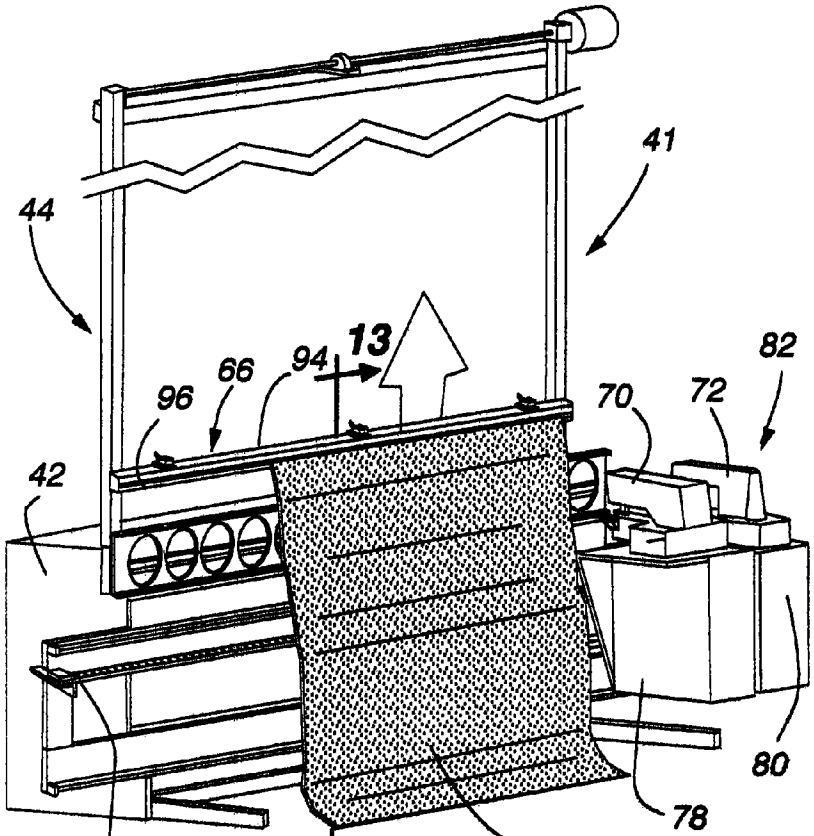
FIG. 5 is a diagrammatic isometric of the apparatus illustrating a first step in treating a fabric.
Figure 8:
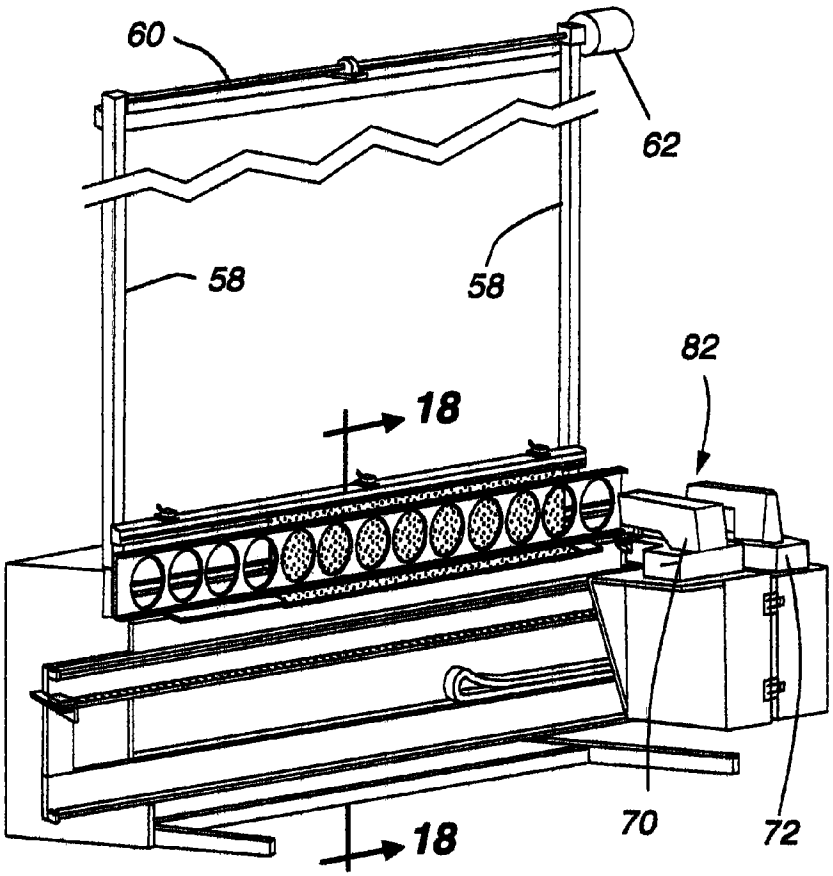
FIG. 8 is a diagrammatic isometric similar to FIG. 7 showing a fourth step in the treatment of a fabric.
Figure 7:
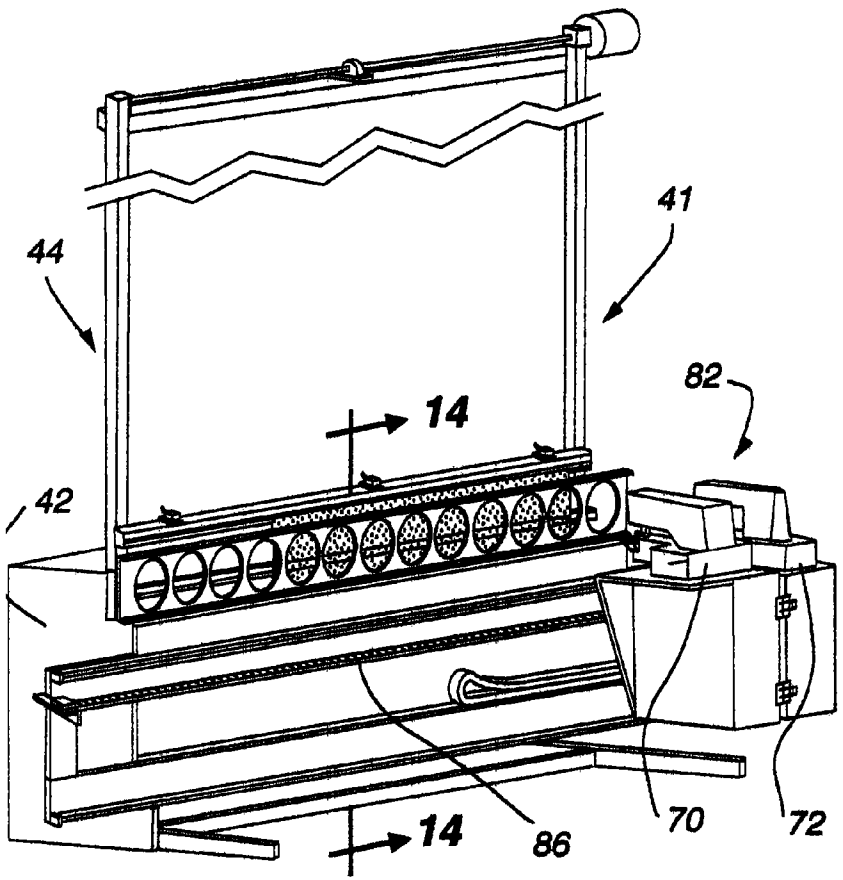
FIG. 7 is a diagrammatic isometric similar to FIG. 6 showing a third step in the treatment of a fabric.
Figure 13:
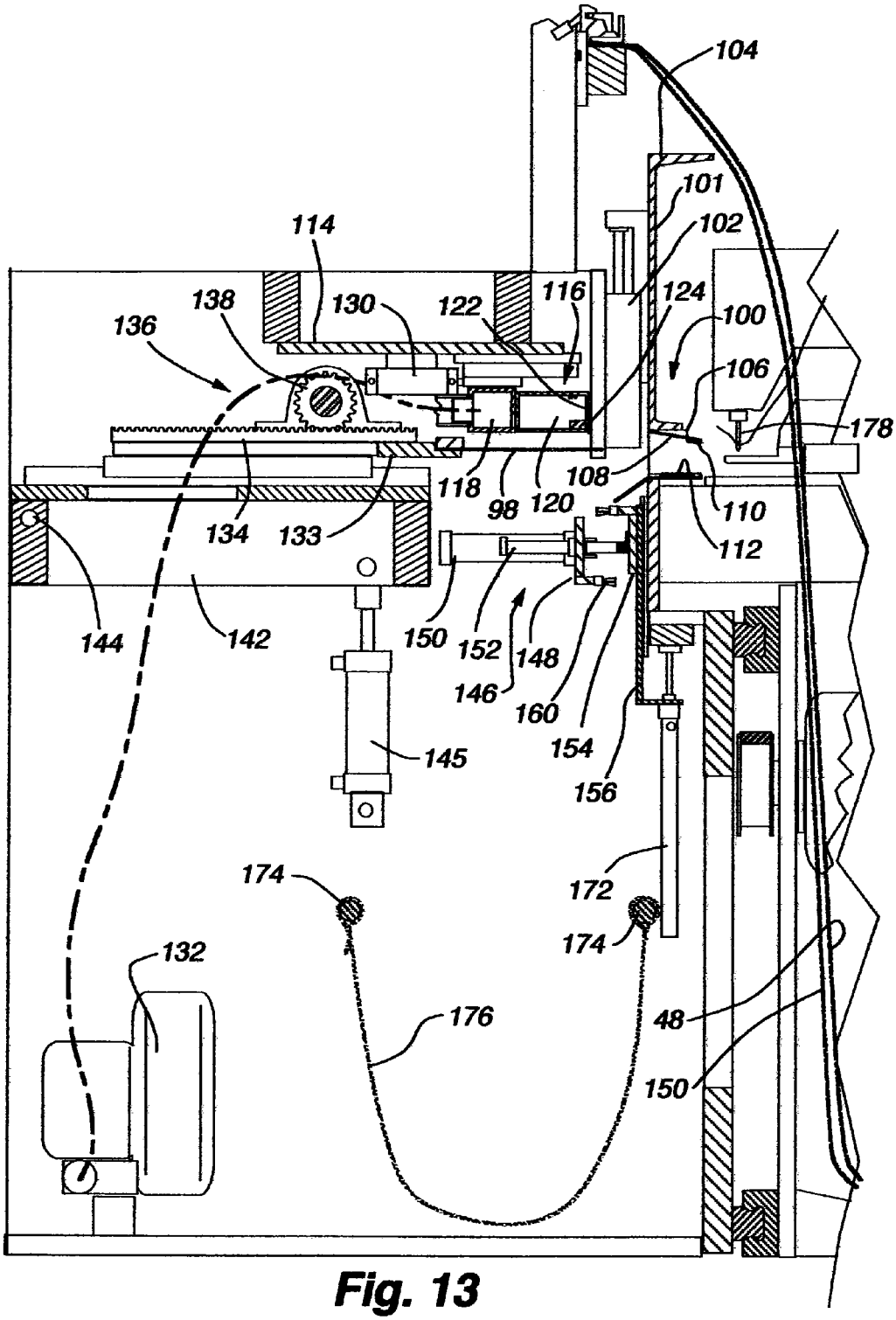
FIG. 13 is an enlarged diagrammatic fragmentary section taken along line 13-13 of FIG. 5.

Referring to FIG. 13, which is a vertical section through the apparatus 41 with the layers 48 and 50 of virgin fabric having been connected to the apparatus as shown in FIG. 5 with the upper clamp 66, the internal working components of the apparatus are shown diagrammatically. It will there be seen beneath the upper clamp is the tuck clamp 100 that includes an elongated horizontally disposed generally U-shaped rail 101 extending the width of the apparatus and connected to a pair of pneumatic cylinders 102 mounted at opposite ends of the rail with mounting brackets 104 on the rear face of the rail. A lower edge of the rail carries a beveled strip 106 supporting a spring steel upper clamp jaw 108 with a gripping edge of material 110 secured on its lower face along a distal edge thereof. The pneumatic cylinders 102 are operative to raise or lower the rail and the upper clamp jaw in a manner such that in a lowered position of the tuck clamp, as seen for example in FIG. 19, the upper clamp jaw engages a tuck 52 of material and presses the material against a platen 112 with a gripping upper surface mounted vertically therebeneath on the housing 42. In the normal elevated position of the tuck clamp, a space is defined between the upper clamp jaw and the platen through which a tuck in the fabric can be advanced for proper positioning relative to the sewing machine carriage 82 as will be discussed later.

In horizontal opposing relationship to the tuck clamp rail 101 and positioned horizontally between the pneumatic cylinders 102 and beneath a support plate 114 in the housing is a vacuum clamp 116. The vacuum clamp includes an elongated horizontally disposed plenum 118 where a low pressure is maintained and a horizontally aligned elongated vacuum chamber 120 communicating with the plenum and having a horizontal slot-like opening 122 in a front wall 124 thereof facing the tuck clamp rail. While the opening 122 extends the full length of the vacuum chamber, an extendable closure tape 126 (FIGS. 32-34) is mounted at one end of the chamber to be selectively extended across a portion of the chamber to close a portion of the opening if the fabric is not wide enough to cover the entire length of the opening. The plenum and vacuum chamber are reciprocally mounted on the plungers 128 of a second pair of pneumatic cylinders 130 secured to the support plate 114 so that when the plungers for the cylinders are extended, the front wall 124 of the vacuum chamber is advanced into engagement with the tuck clamp rail 101. Of course, retraction of the vacuum chamber with a retraction of the plungers 128 of the second pair of pneumatic cylinders 102 withdraws the chamber and moves it to the left as viewed in FIG. 13 so as to define a space between the rail of the tuck clamp and the vacuum chamber. The plenum for the vacuum chamber is connected with a conventional conduit to a selectively operable vacuum pump 132 positioned within the housing.

The tucker blade 98 is a horizontal elongated blade of thin profile extending the full width of the apparatus 41 and mounted on a horizontal support plate 133 secured to the rack 134 of a rack and pinion reciprocal drive system 136 (FIG. 13). The pinion 138 of the drive system is reversibly driven by a motor (not seen). Obviously, rotation of the pinion in one direction drives the rack and the tucker blade horizontally to the right as viewed in FIG. 13 into an extended position as seen in FIG. 18 while rotation of the pinion in the opposite direction retracts the tucker blade to its retracted position of FIG. 13. In the extended position shown in FIG. 18, it is extended between the upper clamp jaw 108 and platen 112 of the tuck clamp 100 with the front elongated edge 140 of the tucker blade being positioned beyond the tuck clamp immediately adjacent to the sewing carriage 82. The horizontal support plate 132 on which the tucker blade is mounted is supported on a lever arm 142 pivotal about a pivot shaft 144 by a pair of low-pressure pneumatic cylinders 145 which could in fact be a gas spring even though in the disclosed embodiment it is a pneumatic cylinder carrying low pressure. The pneumatic cylinders are therefore adapted to pivot the lever arm and thus the tucker blade about the pivot shaft for a purpose to become clear hereafter.

Figure 29:
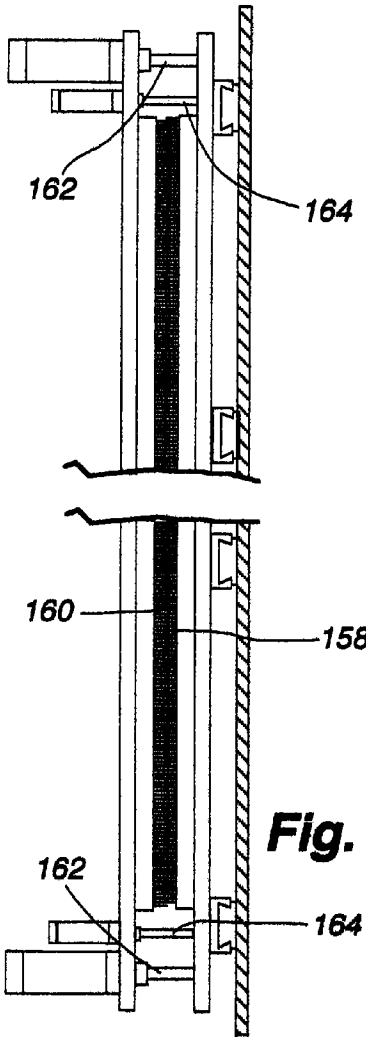
FIG. 29 is a fragmentary section taken along line 29-29 of FIG. 14 showing the lower clamp in a soft clamping position.
Figure 38:
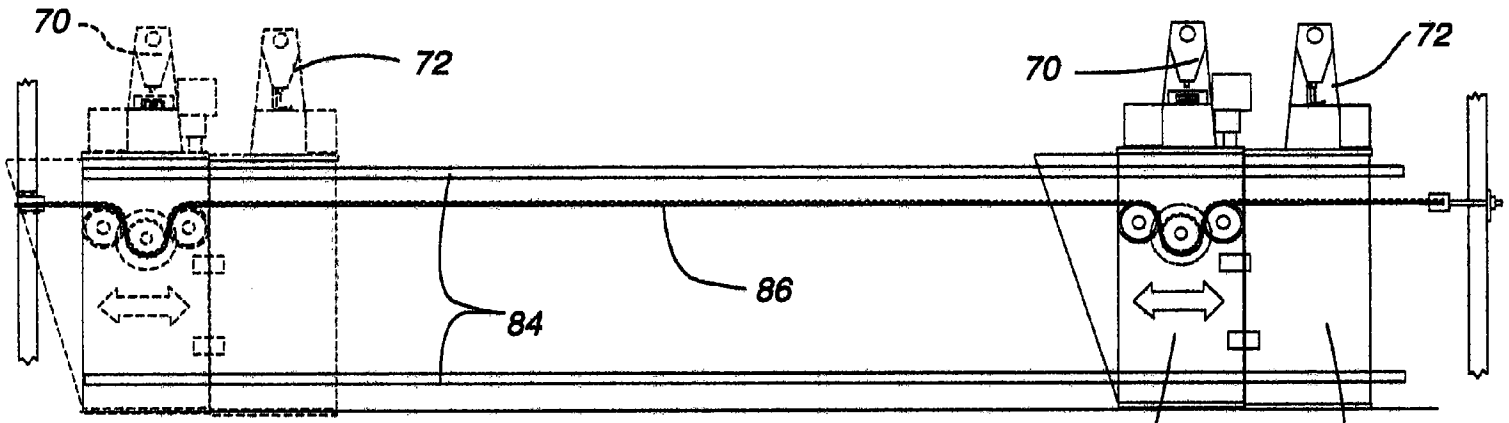
FIG. 38 is a section taken along line 38-38 of FIG. 14.
Figure 40:
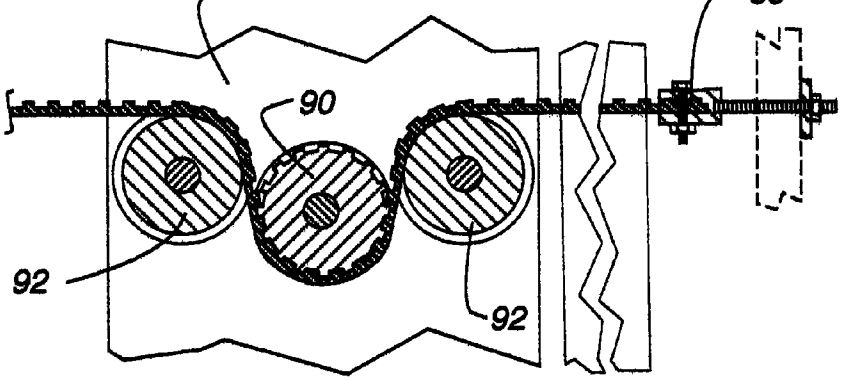
FIG. 40 is a fragmentary section similar to FIG. 39 with the sewing machines positioned at their home position at the right end of the apparatus.
Figure 39:
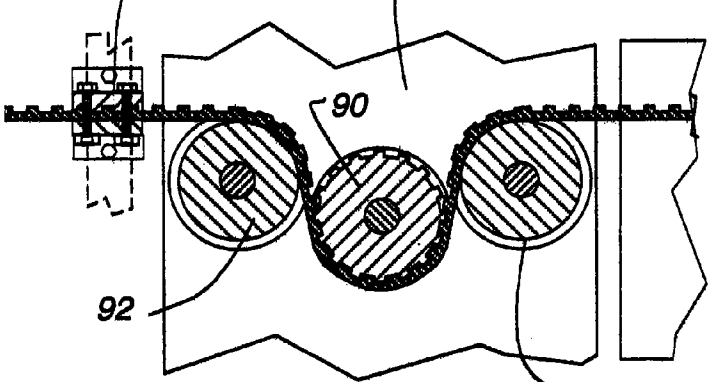
FIG. 39 is an enlarged fragmentary section similar to FIG. 38 showing the drive mechanism for linearly translating the sewing machines with the view taken at the left end of the apparatus when the sewing machines are positioned at the left end.

A lower clamp 146 is positioned beneath the tucker blade 98 at an elevation also beneath the platen 112. The lower clamp has a horizontally movable vertically disposed bar 148 that supports pairs of large 150 and small 152 pneumatic cylinders which are probably best appreciated by reference to FIGS. 29-31. The movable vertically disposed bar confronts a second vertically disposed bar 154 that is fixedly mounted on a vertically movable support plate 156. The fixedly mounted bar has an upper horizontal rearwardly directed brush 158 with a plurality of flexible bristles that overlaps a similar elongated horizontally disposed brush 160 mounted on the movable bar 148. The lower clamp is a three-position clamp and movable between an open position as shown in FIG. 31 wherein the brushes 158 and 160 are not vertically overlapping but rather define a vertical passage therebetween, a soft closed position as shown in FIG. 29 where the brushes partially overlap as seen for example in FIG. 13 as well as FIG. 29 and a fully closed clamping position as shown in FIG.

30 where the lower brush 160 carried by the movable bar is engaged against the fixed bar 154.

The plungers 162 of the large cylinders 150 are secured at their distal end to the fixed bar 154 such that extension of the plungers causes the movable bar 148 to retract or move to the left relative to the fixed bar and retraction of the cylinders causes the movable bar to move to the right toward the fixed bar. The plungers 164 on the small cylinders 152 merely extend into the space between the fixed and movable bars regardless of whether or not they are extended or retracted.

Figure 31:
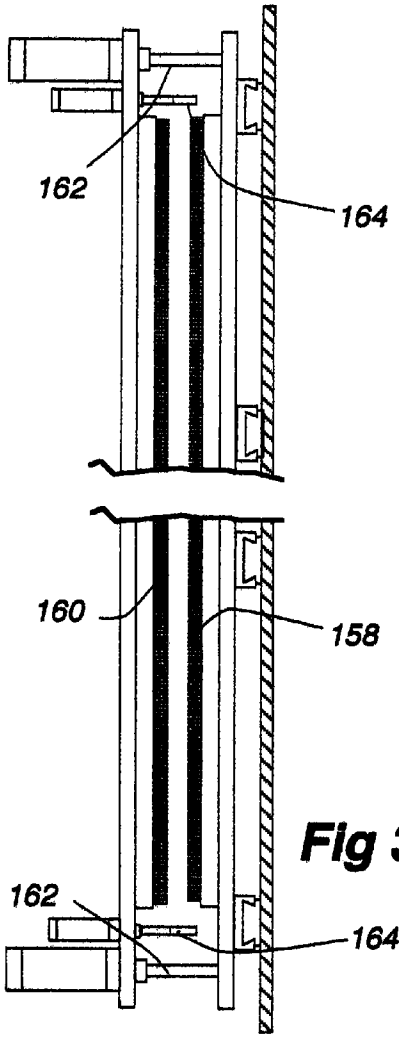
FIG. 31 is a section similar to FIG. 29 showing the lower clamp in an open position.
Figure 30:
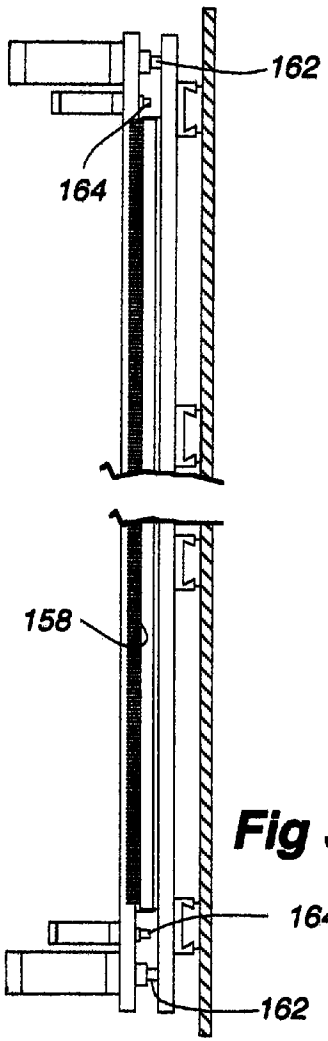
FIG. 30 is a section similar to FIG. 29 showing the lower clamp in a full clamping position.

To move the lower clamp 146 between its three positions, and again with reference to FIGS. 29-30, in the open position of FIG. 31, the large pneumatic cylinder plungers 162 are fully extended so as to fully separate the two bars 148 and 154 and the brushes 158 and 160 mounted thereon to define a vertical gap between the brushes. The plungers 164 of the smaller cylinders 152 are also fully extended but non-engaging with the fixed bar 154 due to their relatively short length. To move the clamp to the soft clamping position of FIG. 29, the large cylinder plungers are retracted to pull the movable bar toward the fixed bar until the plungers of the small cylinders engage the fixed bar to fix the spacing between the movable and fixed bars of the lower clamp. To move the lower clamp to its fully closed and full clamping position of FIG. 30, the plungers on the small cylinders are fully retracted as are the plungers on the large cylinders so the lower brush 160 on the movable bar closely approaches the fixed bar in which position the fabric can be positively gripped for purposes to be described hereafter. A positive grip is best established with a horizontal channel member 166 (FIG. 19) opening off the face of the movable bar 148 and a fixed leg 168 with gripping pads 170 on the fixed bar with the leg being inserted into the channel when the clamp is fully closed.

Figure 17:
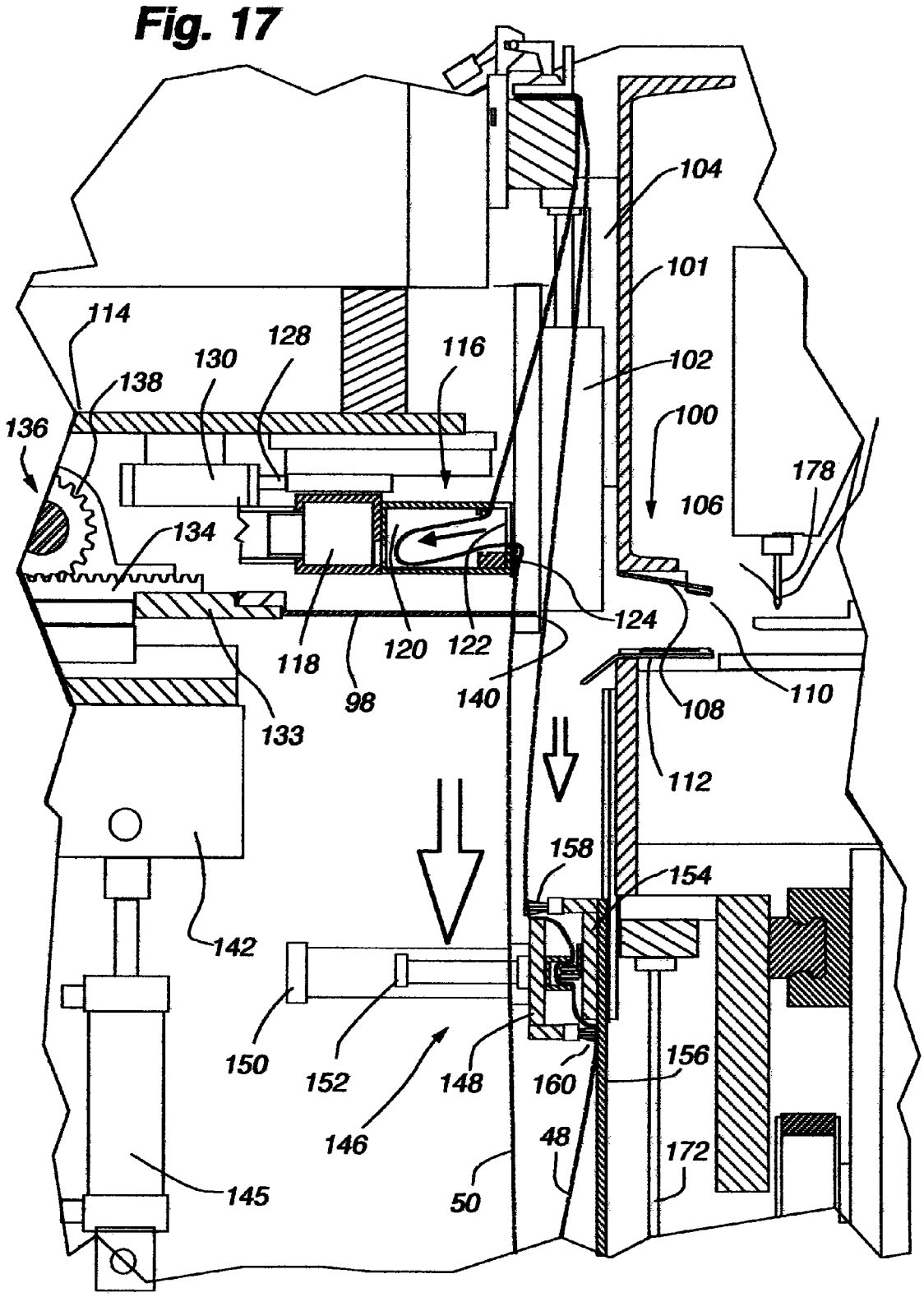
FIG. 17 is a section similar to FIG. 16 with one layer of fabric having been gripped by a lower clamp and removed from the vacuum chamber.

The fixed bar 154, as mentioned previously, is mounted on the support plate 156 that is of L-shaped configuration and itself vertically reciprocably mounted on another pair of pneumatic cylinders 172, which can elevate the fixed bar and movable bar 148 of the lower clamp 146 to the position of FIG. 13, for example, or lower the fixed and lower bars of the lower clamp to the position of FIG. 17.

Also provided within the housing 42 near the bottom thereof are a pair of support rods 174 that support a flexible cradle 176 of any suitable material in which the virgin fabric 68 can gather when the upper clamp 66 is lowered to the position of FIG. 5, for example. In fact, with reference to FIG. 14, a virgin fabric 68 is shown in the position of FIG. 5 and is gathered in the cradle from which it can be removed as the upper clamp is raised during processing of the fabric.

Figure 14:
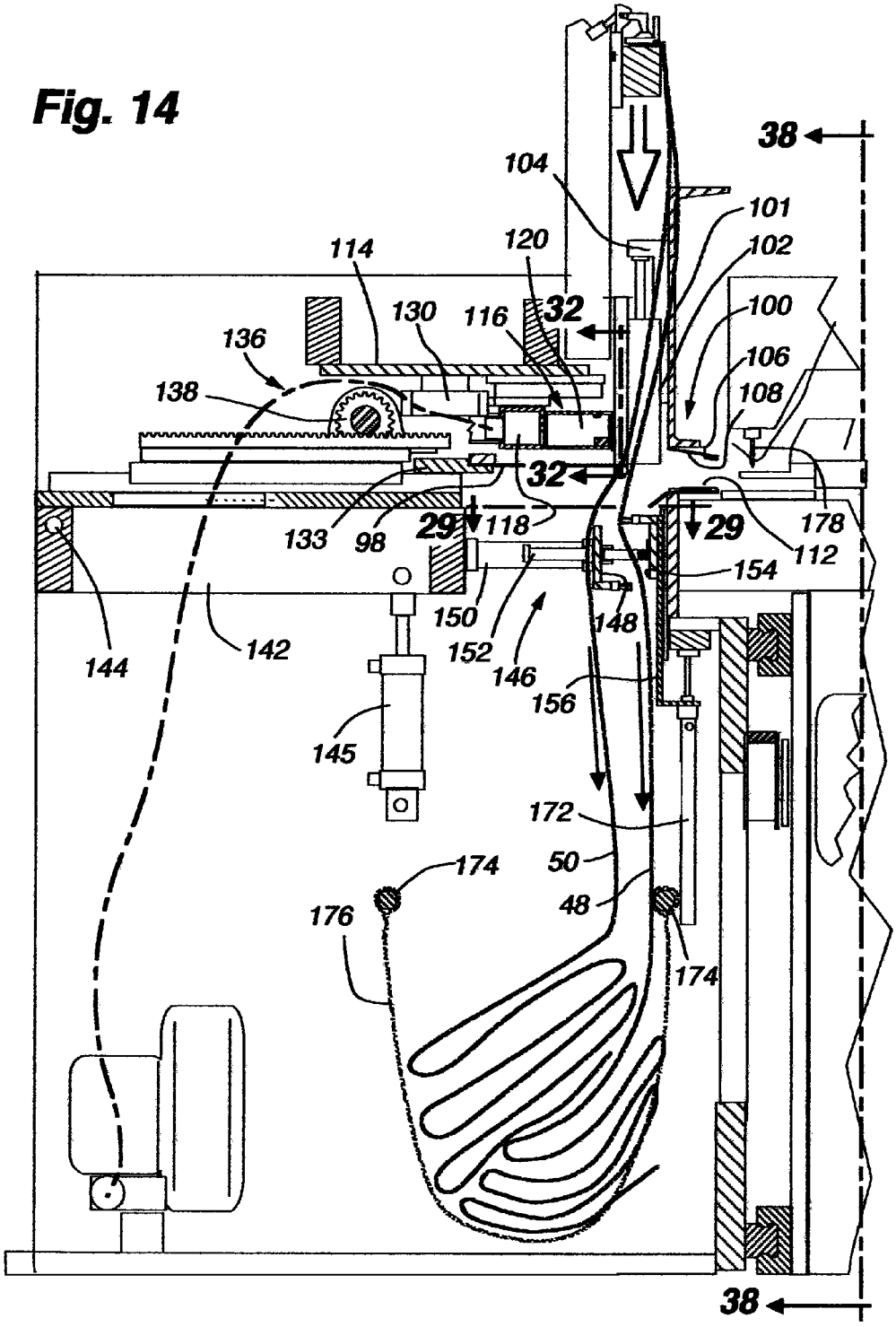
FIG. 14 is an enlarged diagrammatic fragmentary section taken along line 14-14 of FIG. 7.

Referring to FIG. 14, the apparatus 41 is postured for forming a fabric 46 of the type shown in FIGS. 2 and 3 with hobbles 54 and guide loops 74 and for such a fabric, when the upper clamp 66 is lowered to the position of FIG. 5, the rear layer 48 of the fabric is threaded through the lower clamp 146, as shown in FIG. 14, and the front layer 50 of the fabric is passed on the rear side of the movable bar 148 of the lower clamp so as to bypass the lower clamp. As will be appreciated from the description herein, the reference to the layers of the fabric as front 50 and rear 48 layers, for illustrative purposes, is the reverse of the reference to the parts of the apparatus since the fabric is mounted in the apparatus with its front layer facing the rear of the apparatus. It will also be appreciated in the positioning of the fabric in FIG. 14, both layers of the fabric pass freely past the tuck clamp 100 and the vacuum clamp 116 and will also slide through the lower clamp even though the lower clamp is in its soft-clamping position with the rear layer of the fabric engaging the upper and lower brushes 158 and 160 of the lower clamp.

Figure 15:
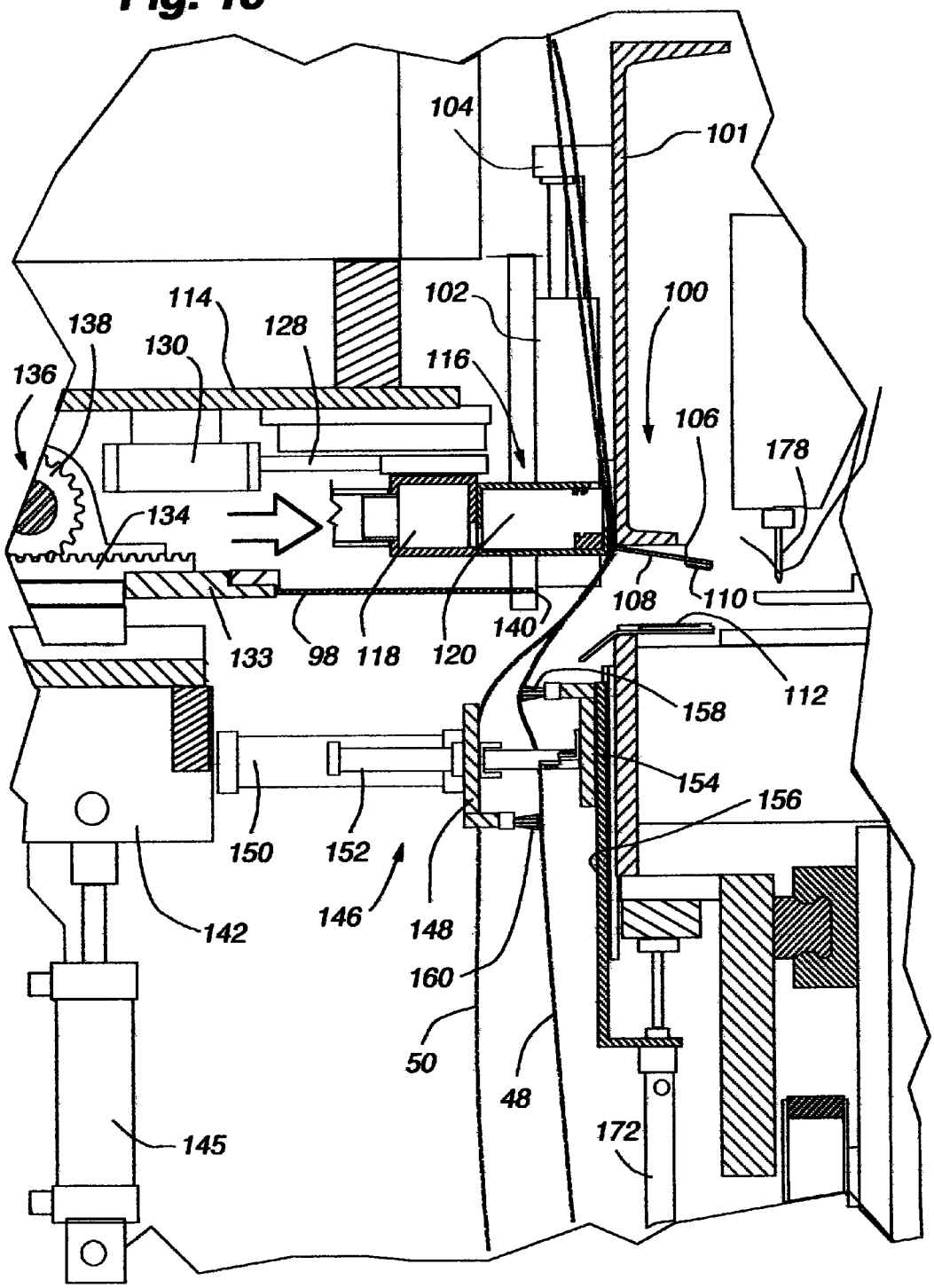
FIG. 15 is a section similar to FIG. 14 showing the vacuum chamber advanced into a clamping position with the fabric.
Figure 16:
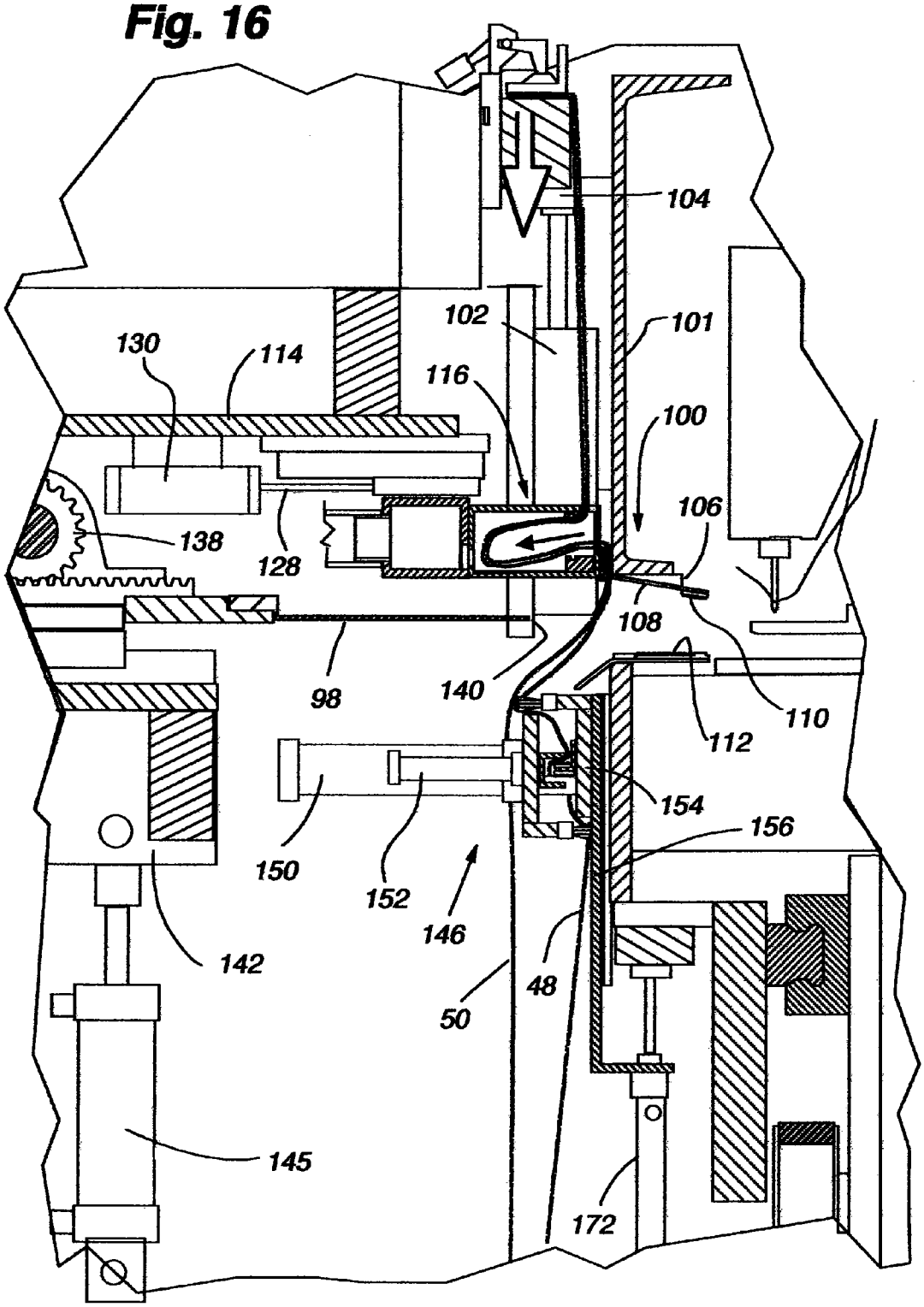
FIG. 16 is a section similar to FIG. 15 with the vacuum chamber having drawn the fabric thereinto.

Referring to FIG. 15, when forming the fabric 46 of FIGS. 2 and 3, having both hobbles 54 and guide loops 74, the first step in the operation is to grip the virgin fabric 68 with the vacuum clamp 116 so the fabric is pinched between the vacuum chamber 120 and the tucker rail 101. The closure tape 126 can be pulled across the opening in the front wall of the vacuum chamber from the left edge of the opening to the left edge of the fabric to maintain adequate vacuum in the chamber. A vacuum is then drawn by energizing the vacuum pump 132 which pulls both layers of fabric into the vacuum chamber as seen in FIG. 16 as the upper clamp 66 is lowered to provide more fabric to the vacuum clamp. Typically, in a fabric of this type, the front layer 50 is less porous than the rear layer 48 so the vacuum is more effective on the front layer but there is enough vacuum to draw both layers into the vacuum chamber.

With both layers 48 and 50 of the fabric drawn a predetermined amount into the vacuum chamber 120, which is permitted by the top clamp 66 being lowered a predetermined amount, the lower clamp 146 is moved into its full clamping position as shown in FIG. 17 so the rear layer of the fabric is fully gripped by the lower clamp but the front layer is free to move up or down. Thereafter, as also seen in FIG. 17, the vacuum clamp 116 is withdrawn and simultaneously the lower clamp is lowered which pulls the rear layer of the fabric out of the vacuum chamber so it is relatively straight while the front layer still forms a loop within the vacuum chamber which will ultimately form a hobble 54 in the fabric.

Subsequently, as shown in FIG. 18, the tucker blade 98 is advanced with the rack and pinion system 136 while the tucker blade is in a horizontal orientation which forces both layers 48 and 50 of the fabric between the upper clamp jaw 108 and the platen 112 of the tuck clamp 100 thereby forming a tuck 52 in both layers of the fabric. Before the tucker blade is advanced, however, the lower clamp 146 is moved to its soft clamp position of FIG. 18 so the rear layer of the fabric is drawn through and across the lower clamp and across the brushes 158 and 160 to remove lint and any wrinkles while the front layer of the fabric, which is freely hanging can be moved therewith. When advancing the tucker blade in this manner, it will be appreciated that since both layers of the fabric are gripped by the vacuum clamp 116, even though only the front layer 50 is drawn into the vacuum chamber 120, all of the material is fed upwardly from below the tucker blade and therefore the material slides slightly across the leading edge 140 of the tucker blade 98. If a hobble 54 was not being formed in the fabric during this step, the vacuum clamp would remain in a retracted position and there would be no loop or hobble of the front layer of fabric in the vacuum chamber. Rather, both layers would be in adjacent side-by-side relationship and by lowering the upper clamp as the tucker blade is advancing, equal amounts of material can be pulled downwardly from above the tucker blade as pulled upwardly from below the tucker blade to avoid having to draw the material across the leading edge of the tucker blade which minimizes any opportunity for damage to the fabric.

Figure 19:
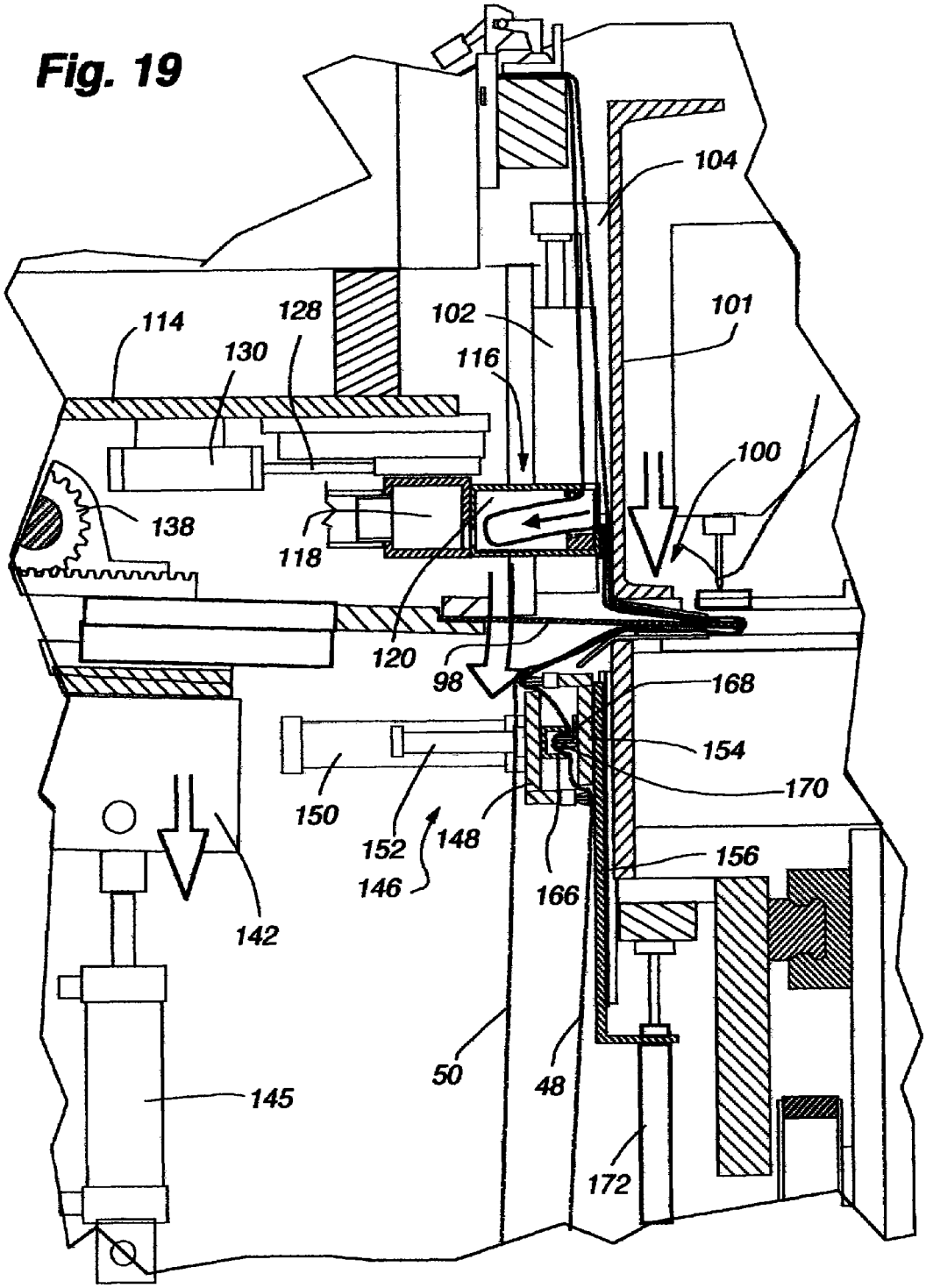
FIG. 19 is a section similar to FIG. 18 with the tucker blade having been tilted.

Referring to FIG. 19, with the tucker blade 98 in the position of FIG. 18, the tuck clamp 100 is lowered so the tuck 52 of fabric with the tucker blade therein is clamped between the upper clamp jaw 108 and the platen 112 of the tuck clamp and due to the bevel or inclination of the upper clamp jaw of the tuck clamp, the tucker blade is tilted which is permitted by pivoting of its support plate 132 about the pivot shaft 144 which is further permitted by the low pressure in the pneumatic cylinders 144 or if the pneumatic cylinders were replaced with a gas spring it would be permitted by the gas spring through minimal resistance to such pivotal movement.

Figure 20:
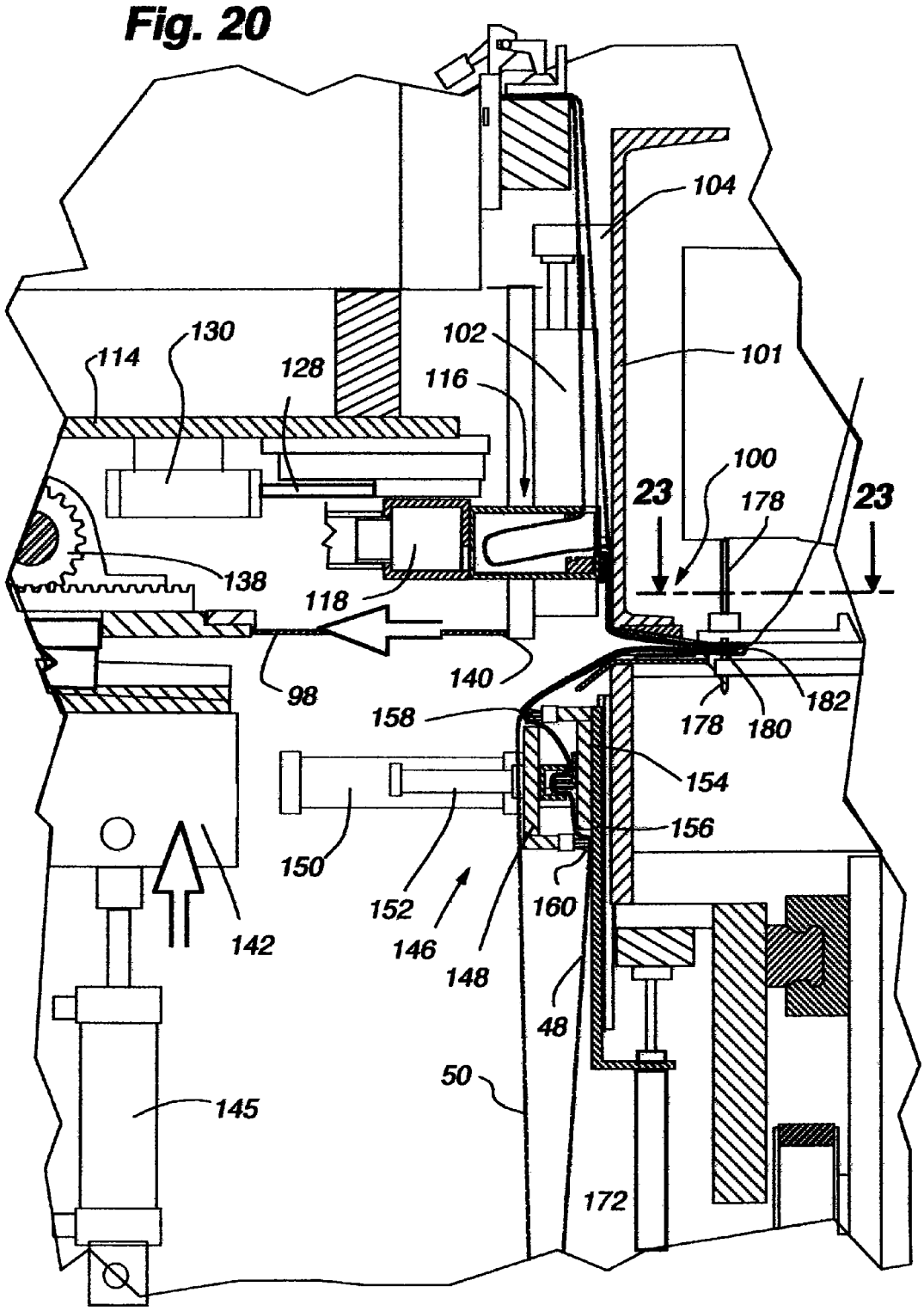
FIG. 20 is an enlarged diagrammatic fragmentary section taken along line 20-20 of FIG. 9.
Figure 21:
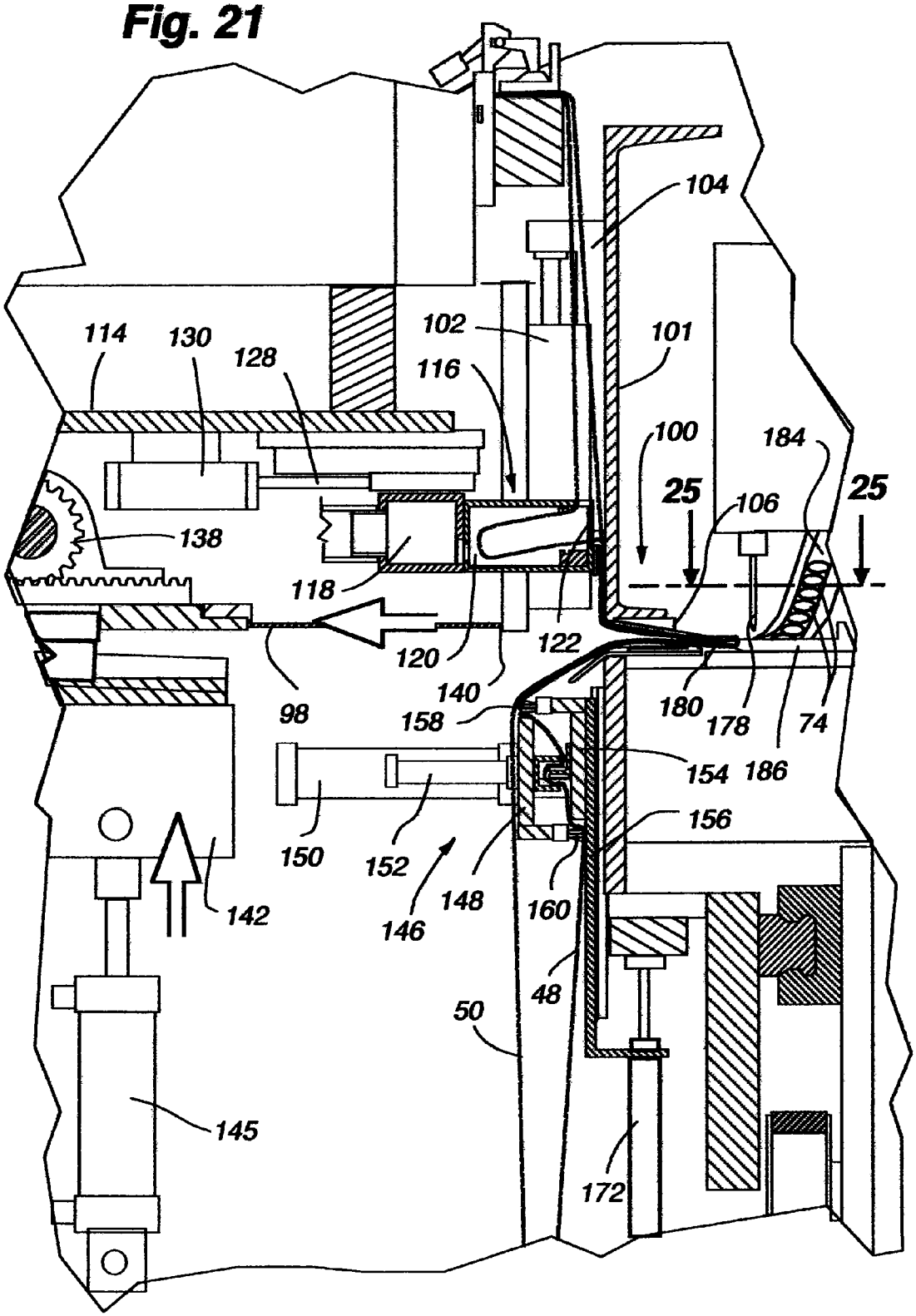
FIG. 21 is an enlarged diagrammatic fragmentary section taken along line 21-21 of FIG. 10.
Figure 22:
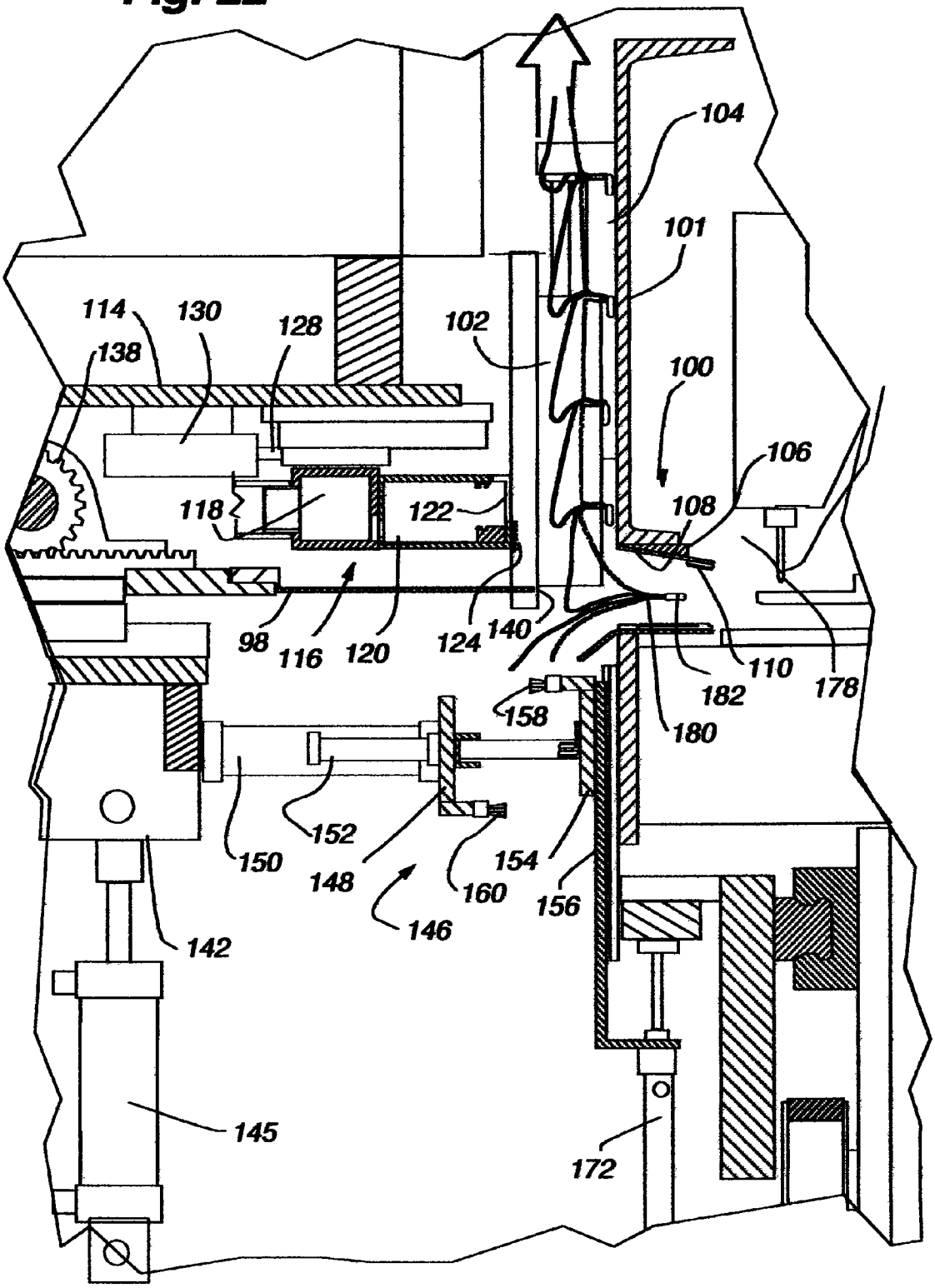
FIG. 22 is a diagrammatic section similar to FIG. 21 showing hobbles and rings having been formed in the fabric in a plurality of horizontal rows.

The tucker blade 98 is coated with Teflon® or another low-friction material so that once the tuck 52 in the material has been gripped by the tuck clamp 100, the tucker blade can be easily withdrawn, as shown in FIG. 20, leaving the tuck of fabric positioned between the upper clamp jaw 108 and platen 112 of the tuck clamp. The low-friction coating of the tucker blade allows easy sliding removal of the tucker blade even though the tuck of fabric is positively gripped and held in position.

Figure 23:
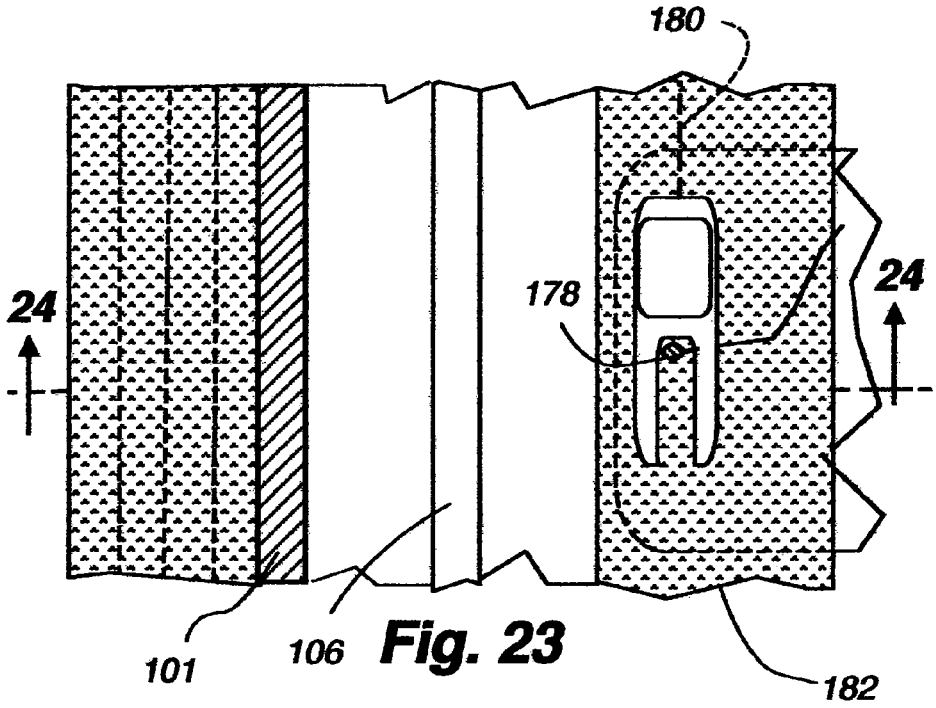
FIG. 23 is an enlarged fragmentary section taken along line 23-23 of FIG. 20.
Figure 24:
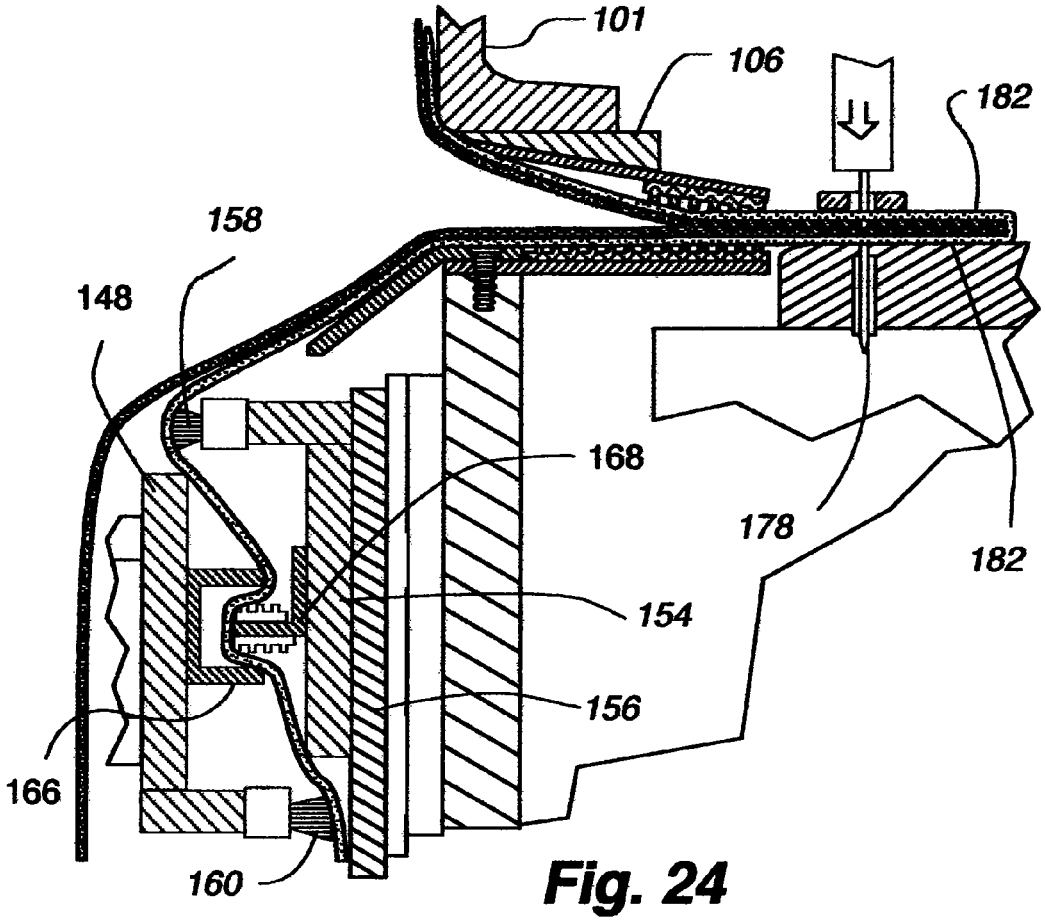
FIG. 24 is a section taken along line 24-24 of FIG. 23.
Figure 25:
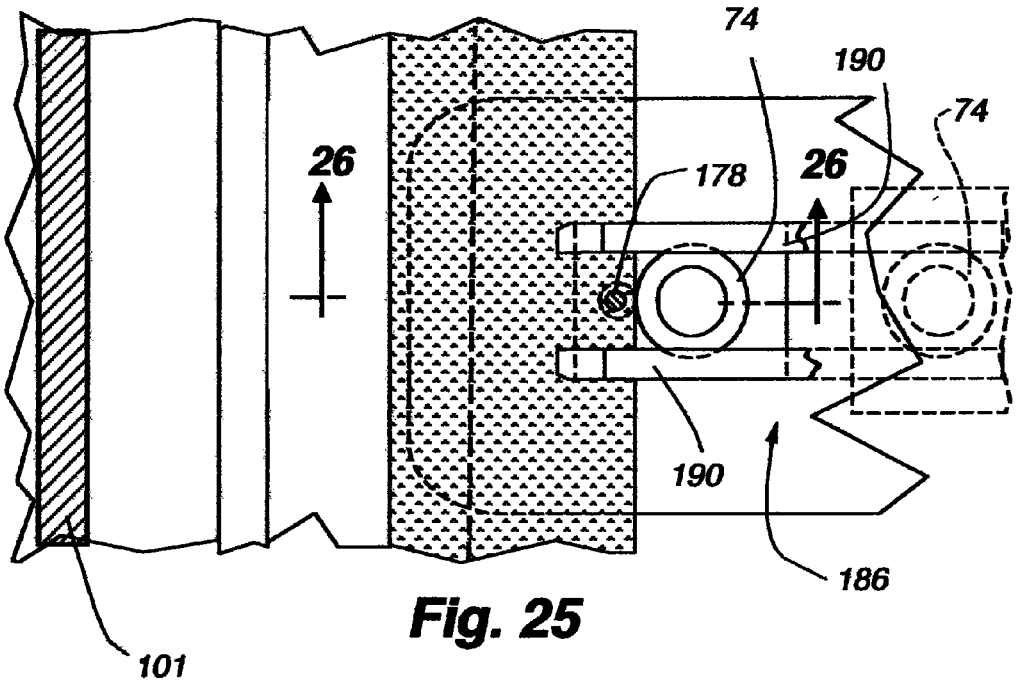
FIG. 25 is an enlarged fragmentary section taken along line 25-25 of FIG. 21.
Figure 26:
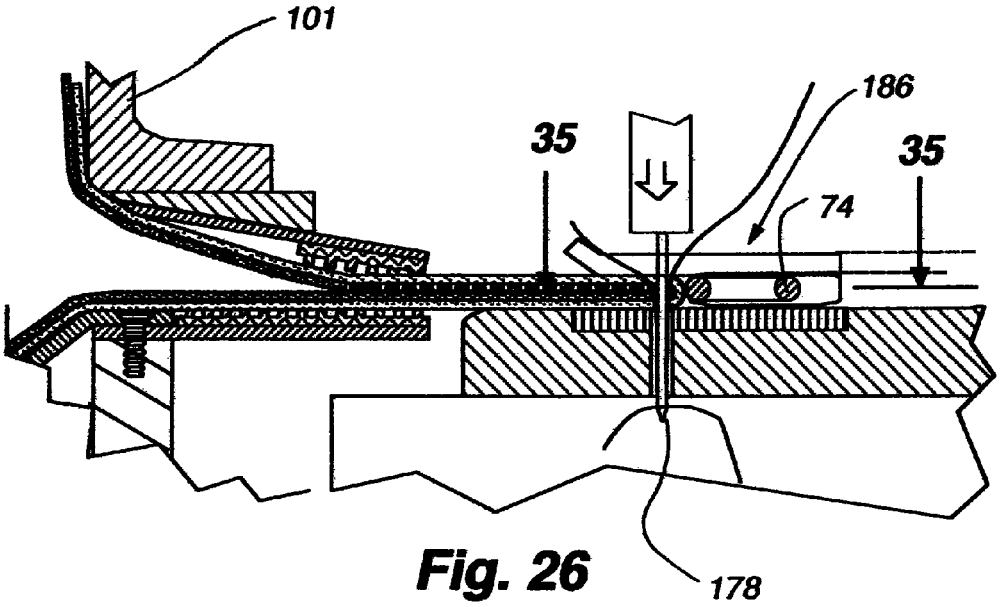
FIG. 26 is a fragmentary section taken along line 26-26 of FIG. 25.
Figure 27:
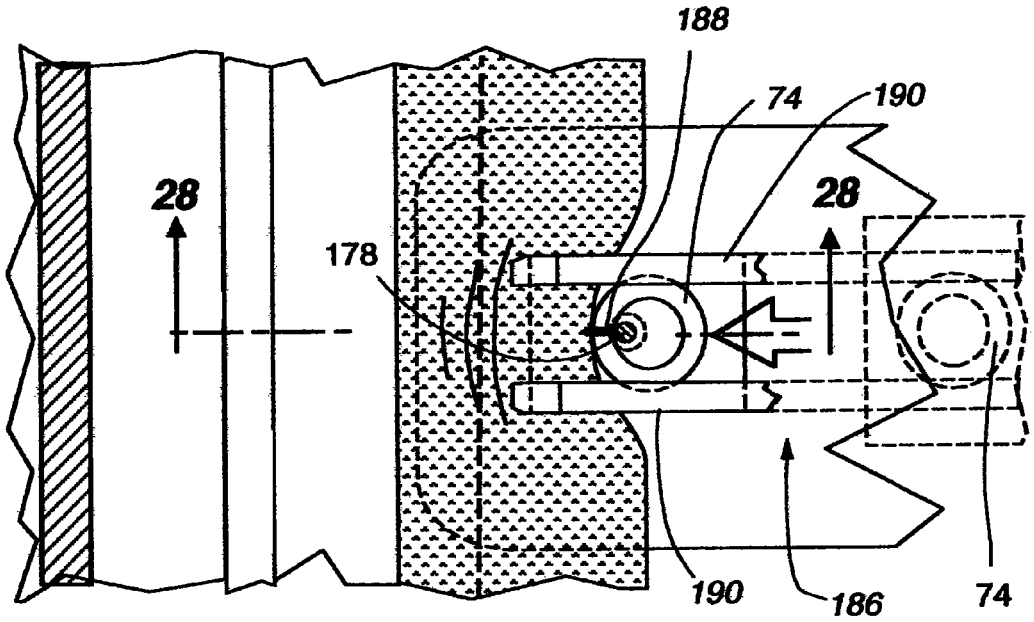
FIG. 27 is a section similar to FIG. 25 showing the ring and fabric having been shifted for receipt of the sewing needle within the ring.
Figure 28:
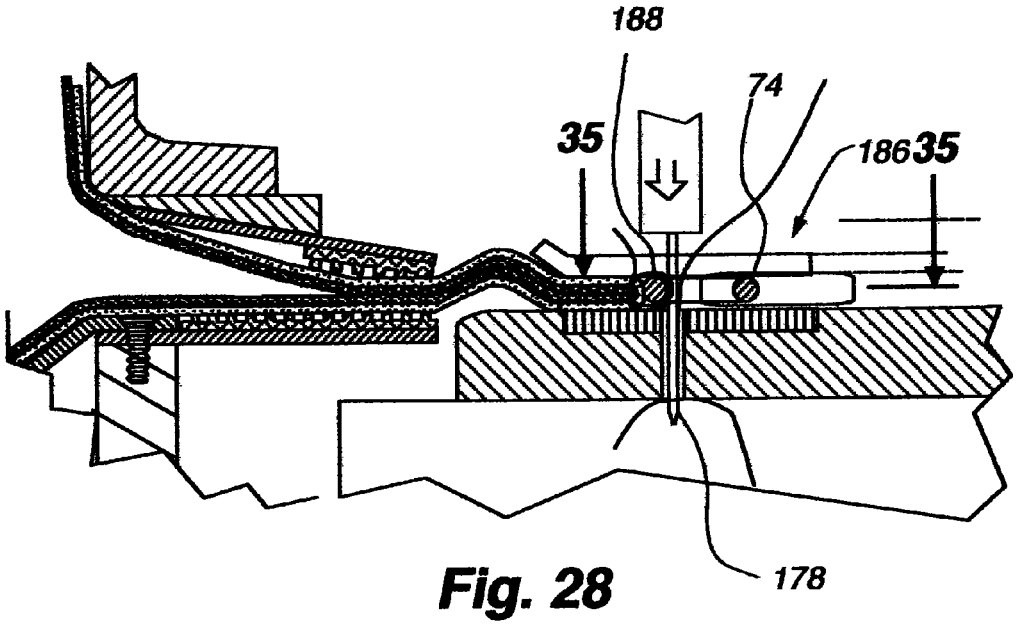
FIG. 28 is a section taken along line 28-28 of FIG. 27.

In the position of FIG. 20, the sewing machine carriage 82 is energized so as to translate from the rest position at the right of the apparatus 41 to the left side of the apparatus and as it is making this pass, the stitching sewing machine 70 is activated while the ring-attaching sewing machine 72 is deactivated. The tuck 52 in material, as can be seen in FIGS. 20 and 23, is aligned with the stitching needle 178 so that as the sewing machine carriage is advanced or translated across the apparatus, a stitch 180 (FIG. 23) is formed in the fabric at a spaced parallel location from the fold 182 at the edge of the tuck. This establishes a tunnel 56 in the tuck between the stitching and the folded edge of the tuck in which a reinforcing bar (not shown) can be placed if desired.

After the stitch 180 has been formed and the carriage 82 is at the left side of the apparatus, the carriage is then driven to the right. The stitching machine 70 is deactivated and the ring-attaching sewing machine 72 is activated to attach rings 74 at predetermined spaced locations along the width of the fabric and along the folded edge 182 of the tuck 52. The spacing of the rings is predetermined depending upon the number of rings desired per width of the fabric and this can all be calculated and computed within the control module.

As mentioned previously, the ring-attaching machine 72 is a conventional button sewing machine which includes a hopper (not seen) for a plurality of buttons or rings 74 and a ramp 184 (FIG. 21) that might vibrate for example that confines a string of rings on a downward sliding path from the hopper to a linearly reciprocating ring gripper 186 as shown in FIGS. 21, 25-28, and 35-37. In the Pfaff ring-stitching machine used in the preferred embodiment of the invention, the sewing needle 178 on the head of the sewing machine 72 reciprocates up and down at a predetermined position but it is desired to stitch across one edge of a ring 74 so that some of the stitches are outside the ring and others are inside the ring so the ring is positively attached to the folded edge 182 of the tuck 52. In order to establish the stitching across the ring, the ring gripper reciprocates forwardly and rearwardly shoving the ring and the edge of the fabric into one position for allowing the sewing needle to establish a stitch 188 (FIG. 27) within the ring and then retracting the ring which allows the folded edge to also return therewith so the folded edge of the material is aligned with the needle. Accordingly, the next stitch 188 can go through the folded edge of the fabric. By repeating this operation, a predetermined number of threads secure an edge of the ring to the folded edge of the tuck. Thereafter, the ring-attaching machine is moved linearly toward its rest position until it is stopped by the control module at a location where the next ring is to be attached and the ring is attached at that location in the same manner.

With reference to FIGS. 25-28 and 35-37, the ring clamp or gripper 186 has two spaced arms 190 with the distance between the spaced arms being adjustable in the Pfaff sewing machine so that in a gripping position shown in FIGS. 25-28, 35 and 36, the ring 74 is positively held so it can be advanced or retracted for desired alignment with the sewing needle 178. After the ring has been attached to the tuck 52, the arms of the ring clamp are retracted as shown in FIG. 37 and the ring clamp itself retracted so the sewing machine can be linearly advanced toward home base and once reaching its next position of attachment for a ring, the arms 190 receive the next ring in line which is dropped therebetween so it too can be gripped and handled as described previously.

As will be appreciated from the above, with one complete reciprocal pass of the sewing carriage 82 across the width of the fabric and back, a tunnel 56 can be formed along the edge of the fabric securing the tuck 52 and rings 74 can be attached at predetermined spaced locations to the tuck. On the opposite face or front layer 50 of the fabric, a hobble 54 is formed during the same operation as a loop of the front layer was confined during the operations within the vacuum chamber 120. Accordingly, a hobble, tunnel and associated rings forming one row of the fabric are established each time the sewing carriage passes through a reciprocating path back and forth across the width of the fabric. After a row has been formed, the upper clamp 66 can be elevated a predetermined distance corresponding to the desired height of a hobble for another identical subsequent operation until a complete fabric 46 has been formed as shown in FIGS. 2 and 3. Once formed, the fabric is simply removed from the upper clamp where it is ready for incorporation into a control system for the architectural covering in which it is to be incorporated.

It will be appreciated from the above that by selecting various operations, a fabric 46 with hobbles 54 and guide rings 74 can be formed as described above or a one or more layer fabric can be formed with simply the guide rings by leaving the vacuum clamp 116 in an inoperative or retracted position so the hobbles are not formed. If tucks were desired with rings, both the stitching and ring attaching sewing machines would be used but if no tucks were desired in the finished fabric, a stitch would not be placed in the tuck established by the tucker blade but only rings would be attached at the folded edge established by the tucker blade. Similarly, if the rings were not desired for a fabric but the hobbles were, then the operation would be as described above except in the return path of the sewing carriage 82, the ring-attaching sewing machine 72 would not be activated so a fabric would be formed with only hobbles.

If only tunnels 56 were desired for the fabric, the vacuum clamp 116 would again be deactivated or retained in its withdrawn position and the two layers 48 and 50 of the fabric would be handled together with both layers passing through the lower clamp 146 but other than this distinction, the formation of horizontal tunnels at vertically spaced locations would follow the above procedure. Again, however, only the stitching machine 70 would be operative and the ring-attaching machine 72 would be deactivated so that tucks 52 and tunnels were formed off the rear of the fabric along parallel vertically spaced lines. Of course, if the tunnels were desired on the front of the fabric, the virgin fabric 68 could be reversed in the upper clamp 66 so the tunnels were formed on the front of the fabric rather than the rear.

Clearly from the various options available with the apparatus, fabric for different types of coverings for architectural openings can be made automatically. Further, varying widths of fabrics can be handled up to the spacing of the lift towers on the lift rack.

The second embodiment 200 of the apparatus of the invention is shown in FIGS. 41-67. This embodiment of the invention is somewhat similar to the previously described embodiment and accordingly, where appropriate, like parts have been given like reference numerals.

In the second embodiment, the vacuum clamp 116 of the first embodiment has been removed and replaced with a stabilizing clamp 202 so there is no longer a vacuum chamber 120 into which fabric is drawn when forming a hobble. Further, there is no lower clamp 146. In addition, there are two lift racks 44*f* and 44*r* that are identical except the rear rack 44*r* is higher than the front rack 44*f*. The remainder of the apparatus is identical to the first-described embodiment including the sewing machines 70 and 72 and their mounting on a sewing machine carriage 82. The tucker blade 98 is identical to that of the first-described embodiment and operates in the same manner so as to cooperate with the tuck clamp 100 and the sewing machines in forming tucks 52 and/or attaching rings 74 to the fabric. In the second embodiment to be described hereafter, the hobbles 54 are formed in a different manner since the vacuum system used for forming hobbles in the first embodiment has been removed.

Figures 41, 42:
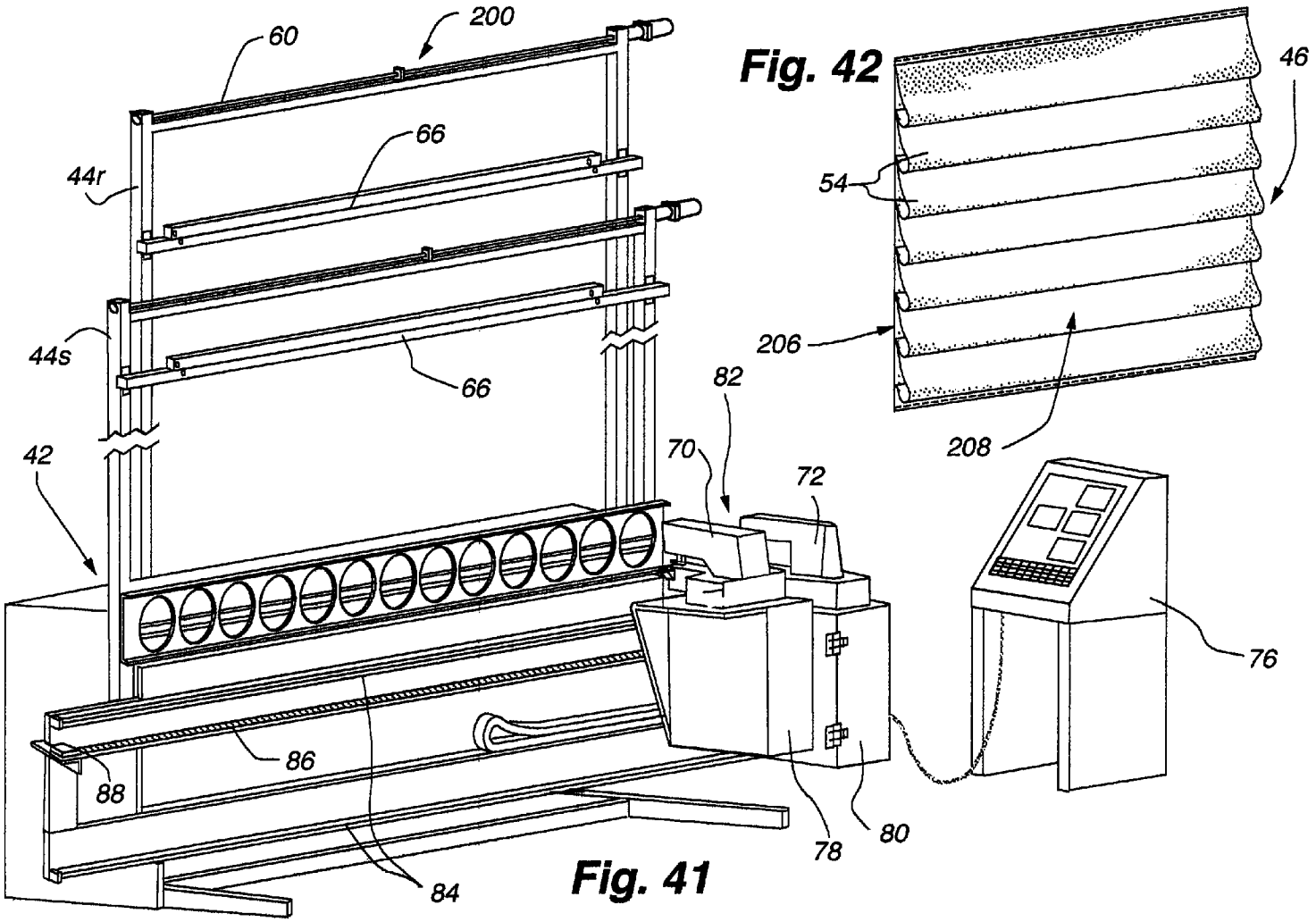
FIG. 41 is an isometric of a second embodiment of the apparatus of the present invention.
FIG. 42 is a front isometric of a fabric formed from the apparatus of FIG. 41 having hobbles formed on the front face thereof.
Figures 43, 44:
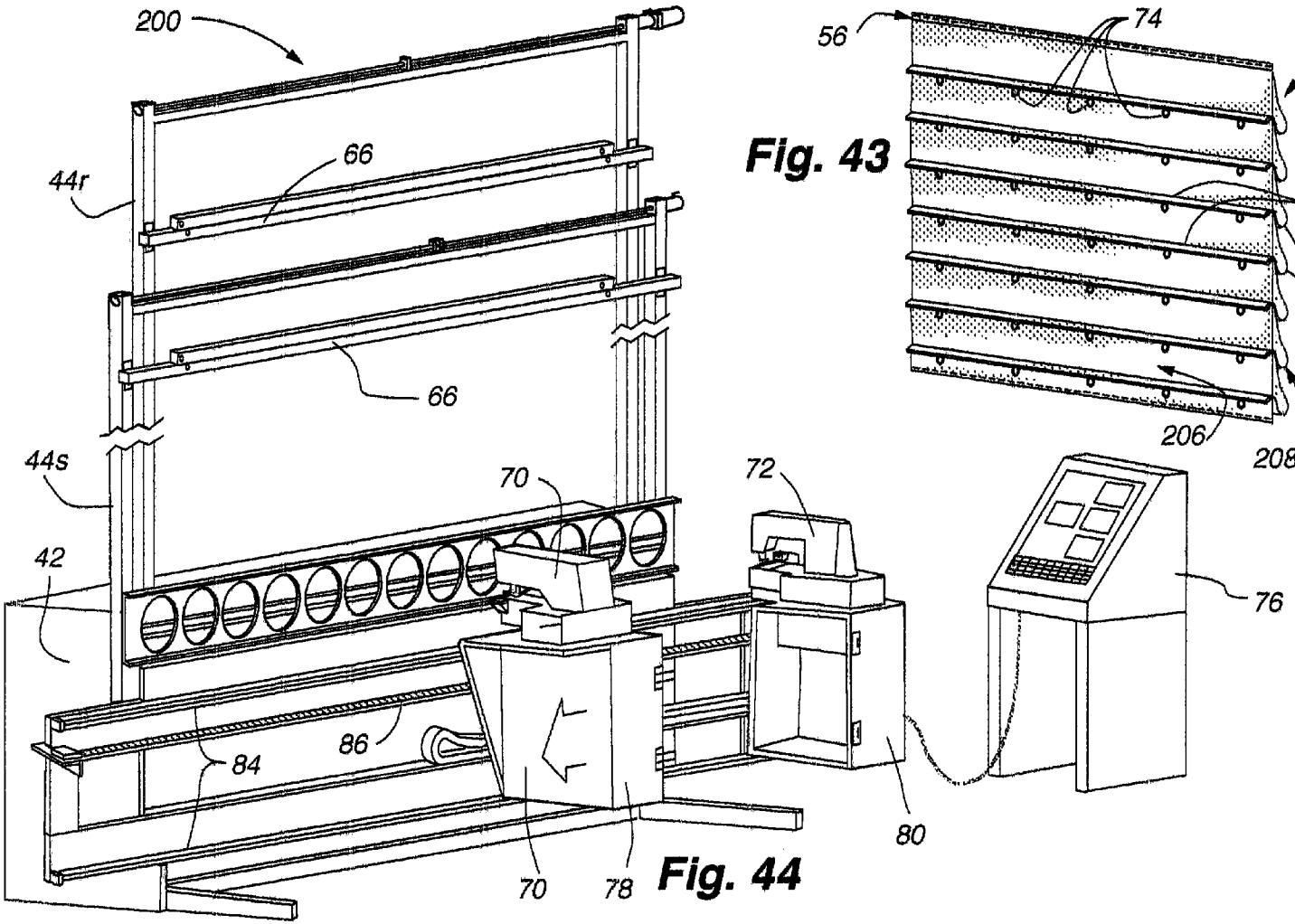
FIG. 43 is a rear isometric of the panel shown in FIG. 42 showing tucks and rings sewed to the panel.
FIG. 44 is an isometric similar to FIG. 41 showing the sewing machines separated as for maintenance purposes.

The two lift racks 44*f* and 44*r*, as mentioned, are identical to each other and to the lift rack 44 of the first embodiment except the lift rack 44*r* is slightly taller than the lift rack 44*f* as can be seen in FIG. 41.

Figure 53:
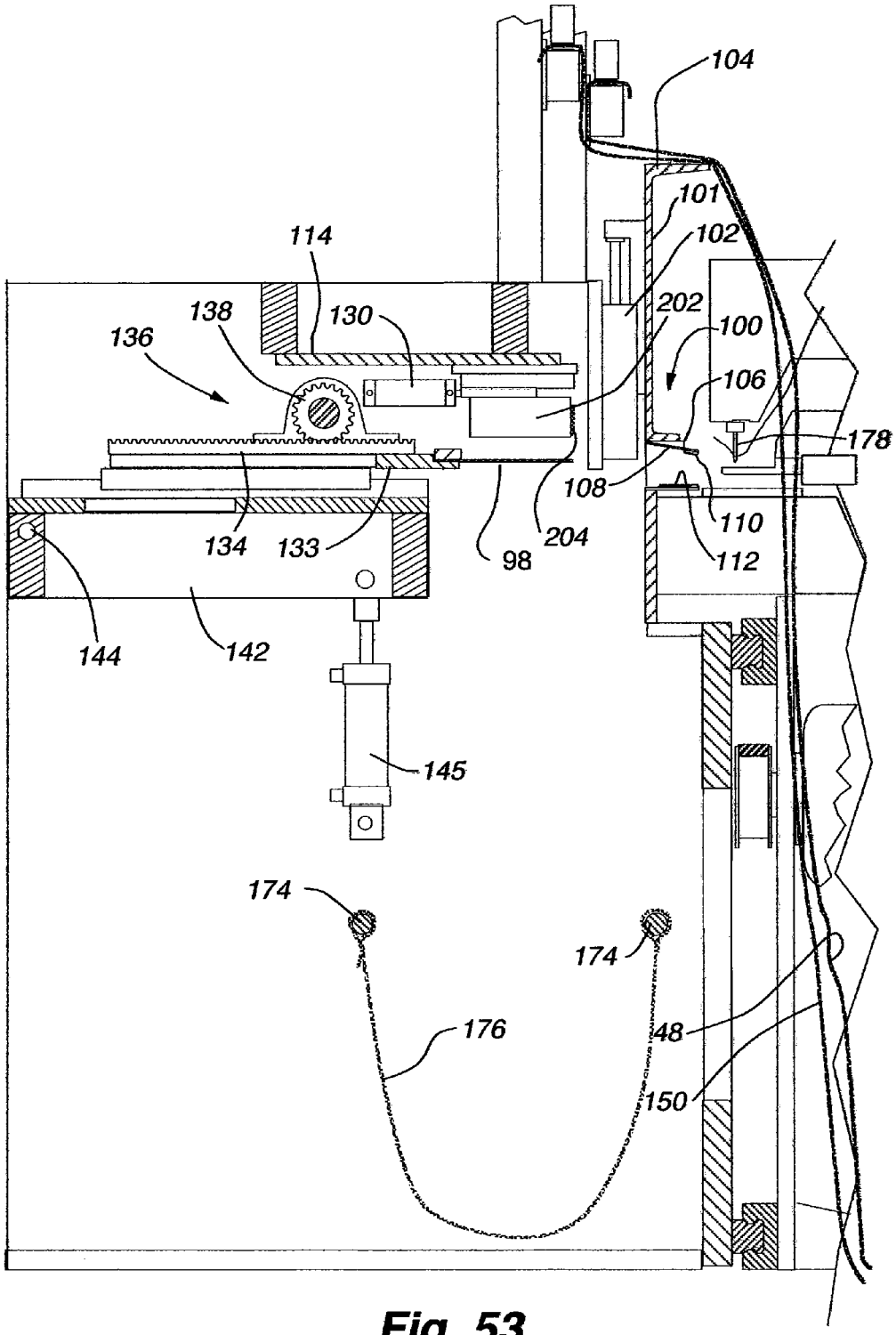
FIG. 53 is an enlarged section taken along line 53-53 of FIG. 45.
Figure 54:
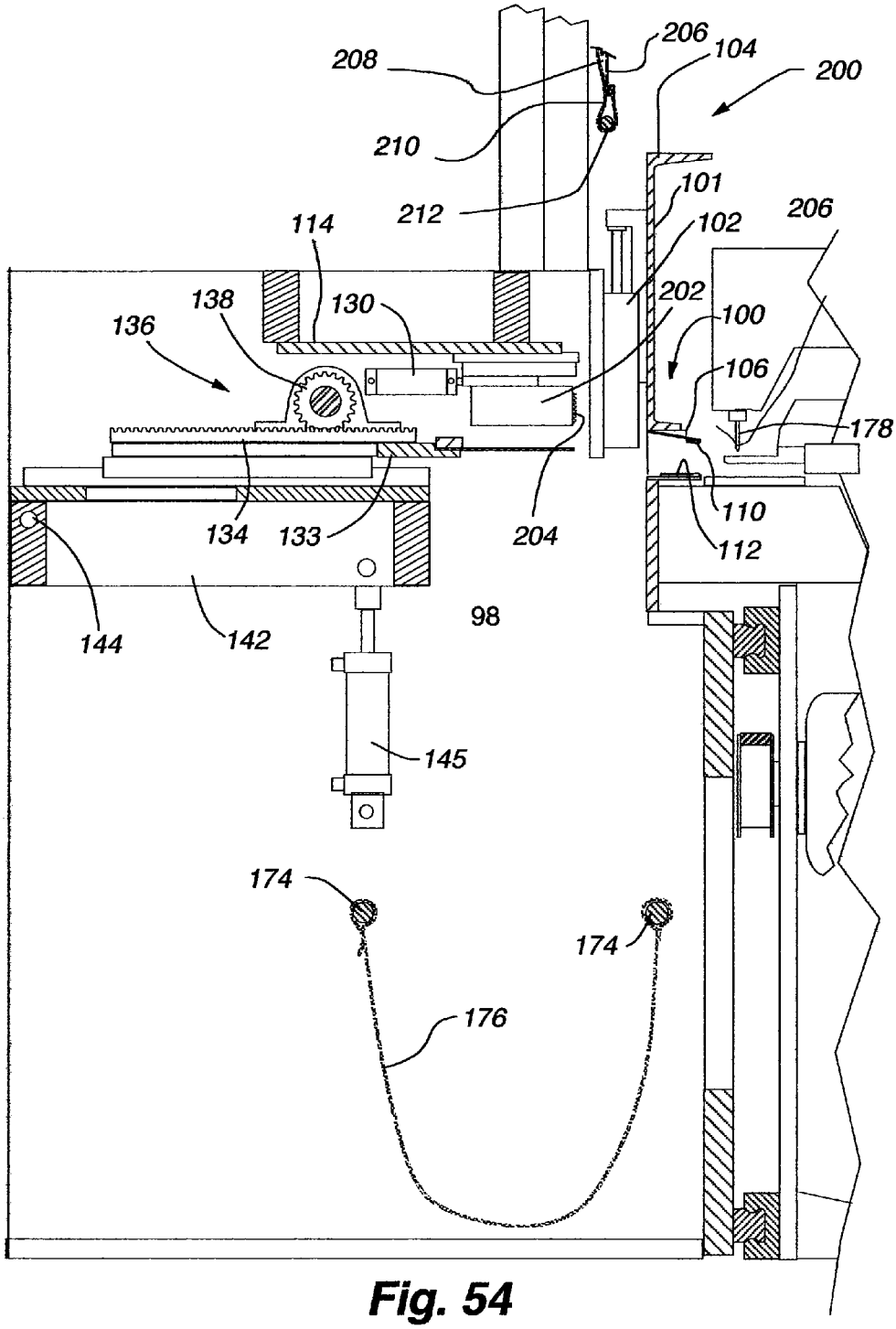
FIG. 54 is an enlarged section taken along line 54-54 of FIG. 46.

With reference to FIG. 53, the stabilizing clamp 202 can be seen to have replaced the vacuum clamp 116 of the first-described embodiment and includes a gripping head 204 for compressing engagement with the fabric to hold the fabric against the U-shaped rail 101. The stabilizing clamp head is reciprocated with the pneumatic cylinder 130 in the same manner of operation as in the first-described embodiment. Similarly, the tuck clamp 100 is opened and closed through the use of the same pneumatic cylinder 102 which raises and lowers the upper clamp jaw 108 into and out of engagement with the lower clamp jaw or platen 112. Also, the tucker blade 98 is again reciprocated in a horizontal plane with the rack and pinion reciprocal drive system 136.

Figure 45:
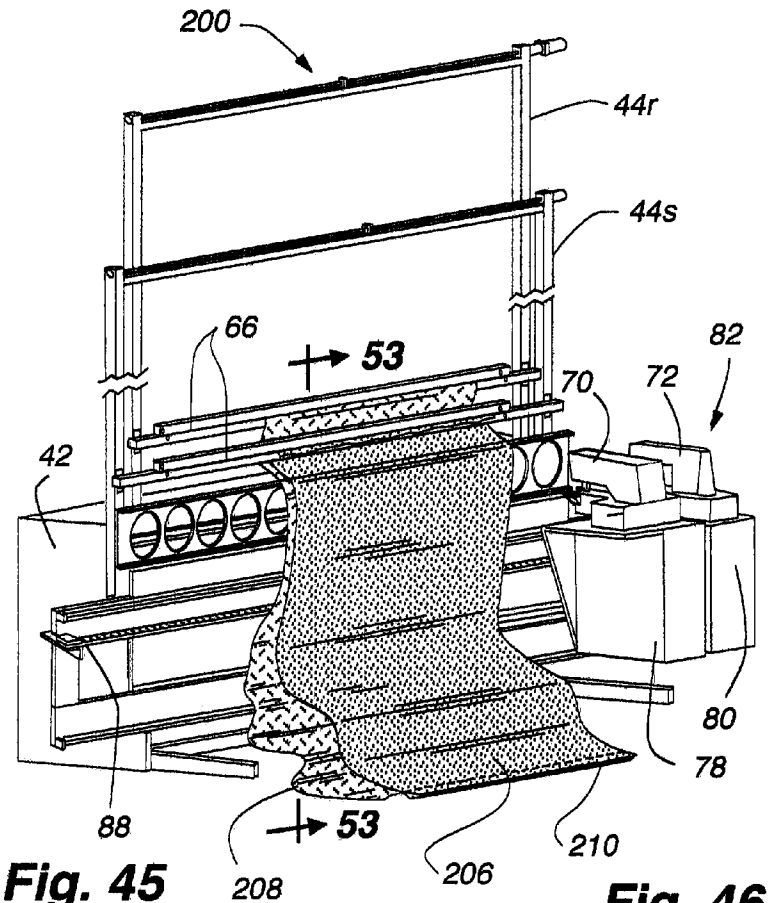
FIG. 45 is a front isometric of the apparatus of FIG. 41 with the upper edge of two sheets of fabric material anchored to lift towers of the apparatus in preparation for processing a fabric as viewed in FIGS. 42 and 43.
Figure 48:
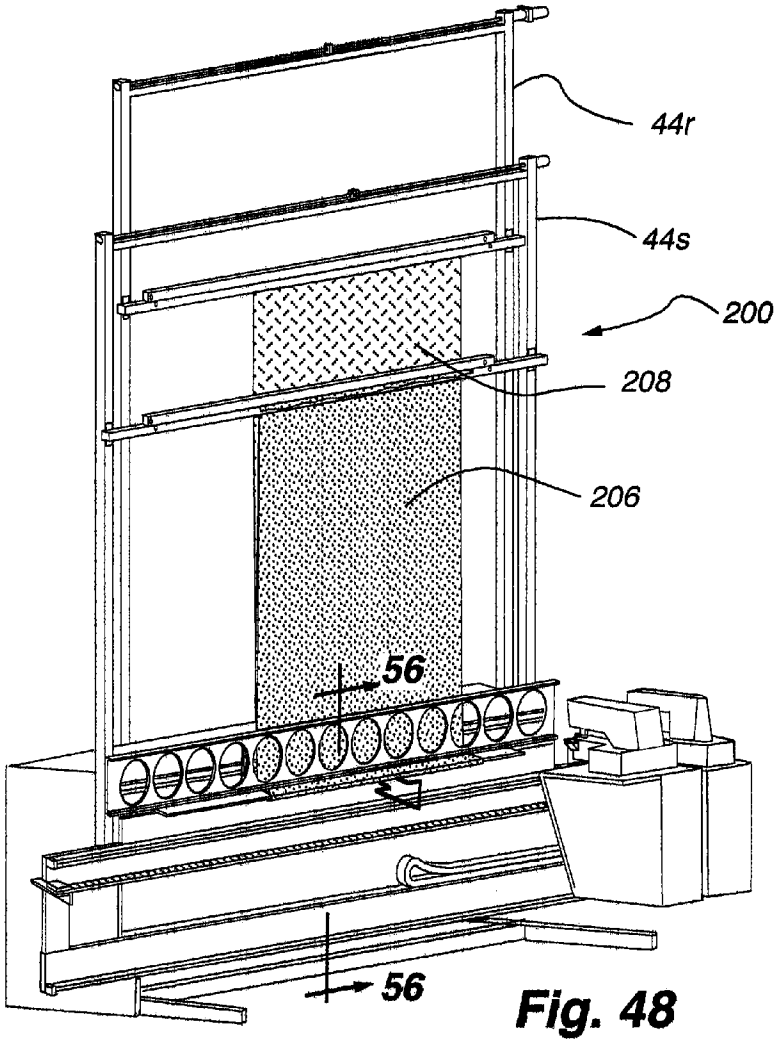
FIG. 48 is an isometric similar to FIG. 47 with the tucker blade having been advanced into the sheets of fabric material for forming a tuck in the material.
Figure 47:
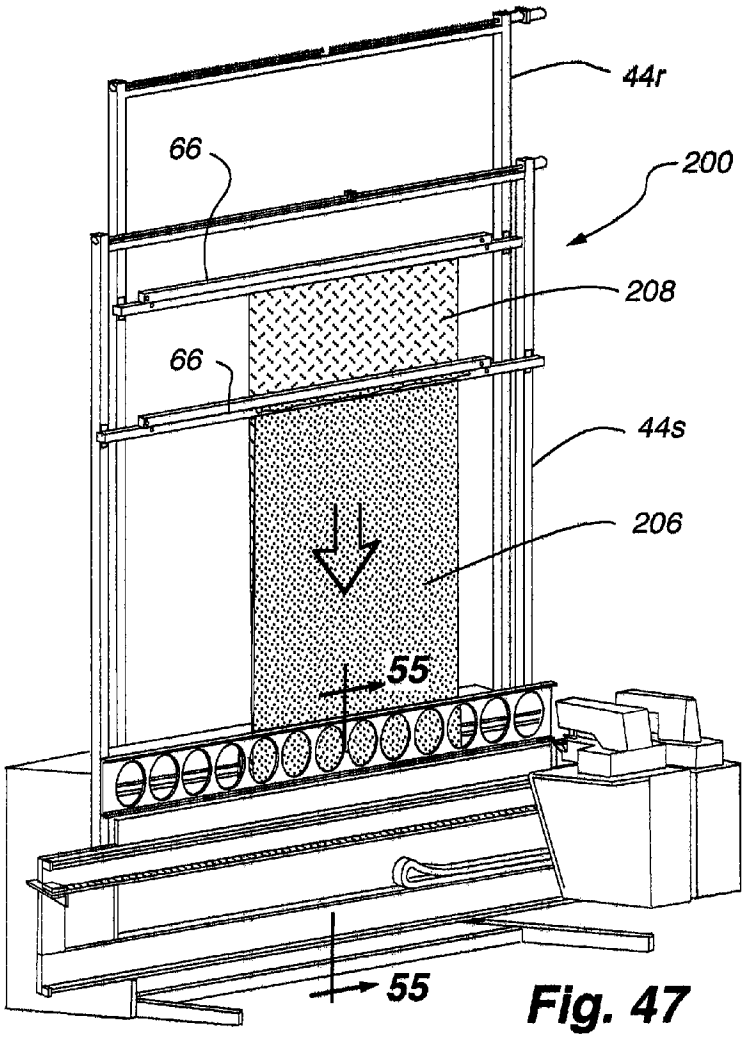
FIG. 47 is an isometric similar to FIG. 46 with the panels of fabric material having been dropped into a position for initial operation of the apparatus.
Figure 50:
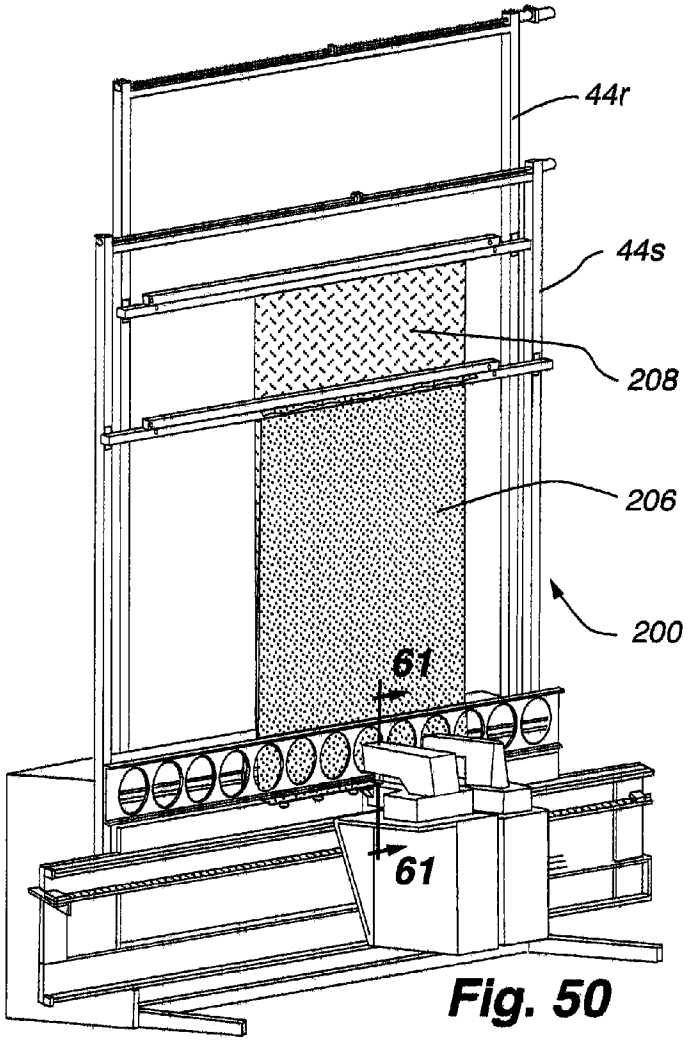
FIG. 50 is an isometric similar to FIG. 49 with the ring sewing machine positioned to initiate a stitch into a ring for attachment to a fold in the sheets of material.
Figure 49:
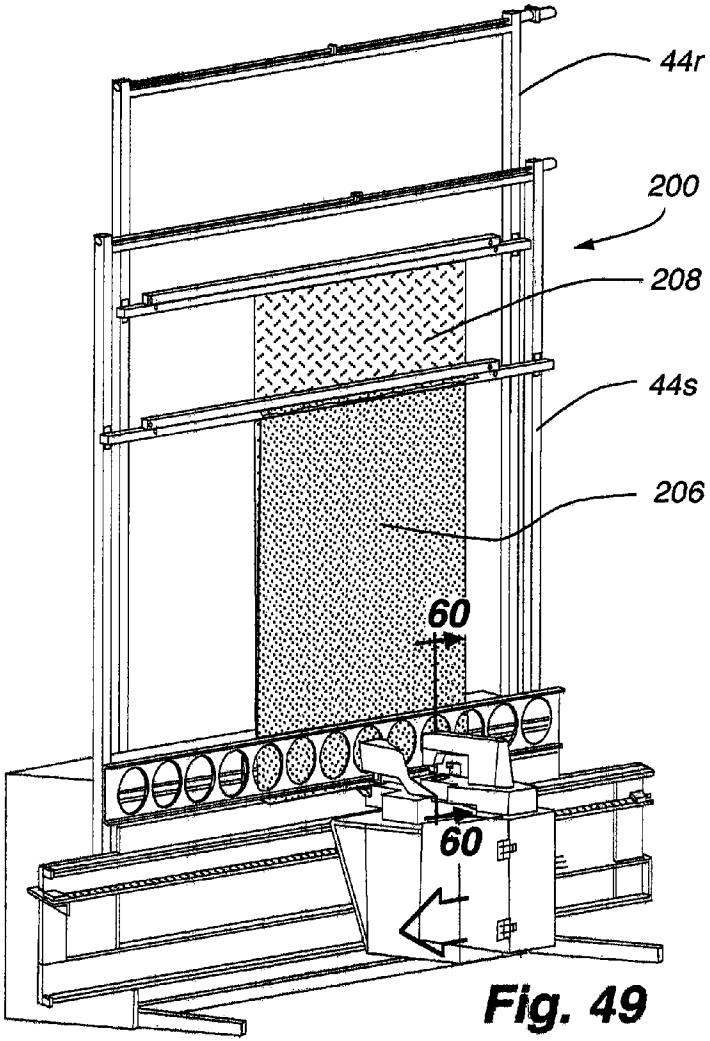
FIG. 49 is an isometric similar to FIG. 48 with the tucker blade having been removed from the fabric sheets and the ring sewing machine positioned for initiating an attachment stitch into the fold of the sheets of material.
Figure 52:
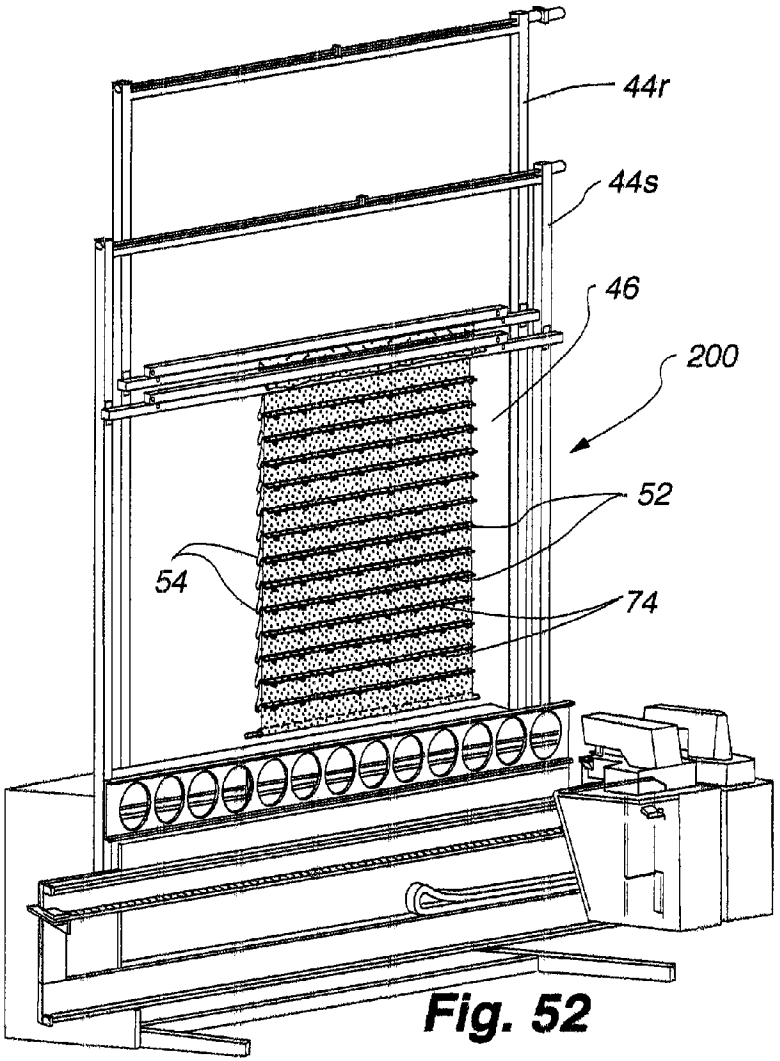
FIG. 52 is an isometric similar to FIG. 51 with the lift tower having elevated the completed fabric.
Figure 51:
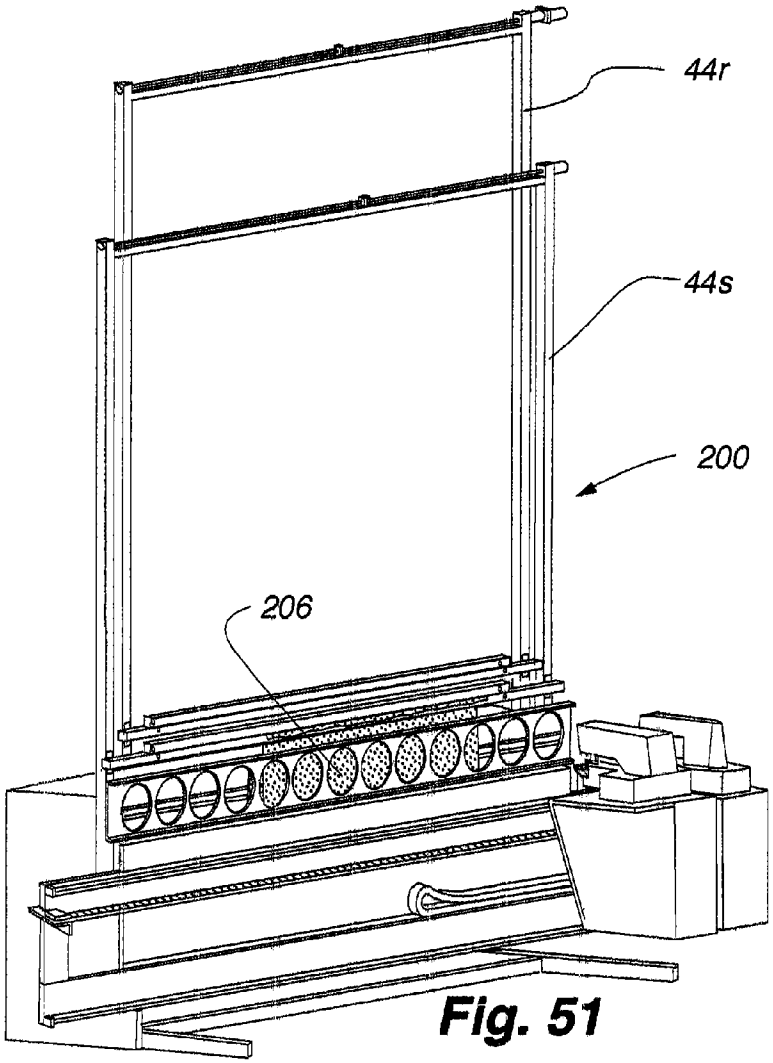
FIG. 51 is an isometric similar to FIG. 49 with a complete fabric having been formed showing the lift tower at its lowermost position.

In initially describing the operation of the second embodiment of the apparatus, it will be described in connection with the fabrication of a fabric 46 as illustrated in FIG. 42 wherein a back or backing sheet of material 206 and a front sheet 208 are interconnected and horizontal hobbles 54 are formed in vertically spaced relationship with each other on the front sheet by forming loops of the front sheet material and securing the looped sheet material of the front sheet to the rear sheet. In accordance with the second embodiment of the invention, the front and rear sheets of material that are sewn together with the apparatus of the invention are pre-treated as in the first described embodiment by sewing a lower edge of the sheets of material together preferably defining a hem 210 in which a weighted bottom rail or ballast bar 212 can be inserted. The back sheet 206, which lies toward the front of the machine, is shorter than the front sheet 208 as can be seen, for example, in FIG. 46, and is clamped along its upper edge to an upper clamp 66 on the front lift rack 44*f*. The upper edge of the front sheet is attached to the upper clamp 66 associated with the rear lift rack 44*r*. This can be done with both lift racks being lowered as shown in FIG. 45 where the clamps are readily accessible to an operator.

Figure 46:
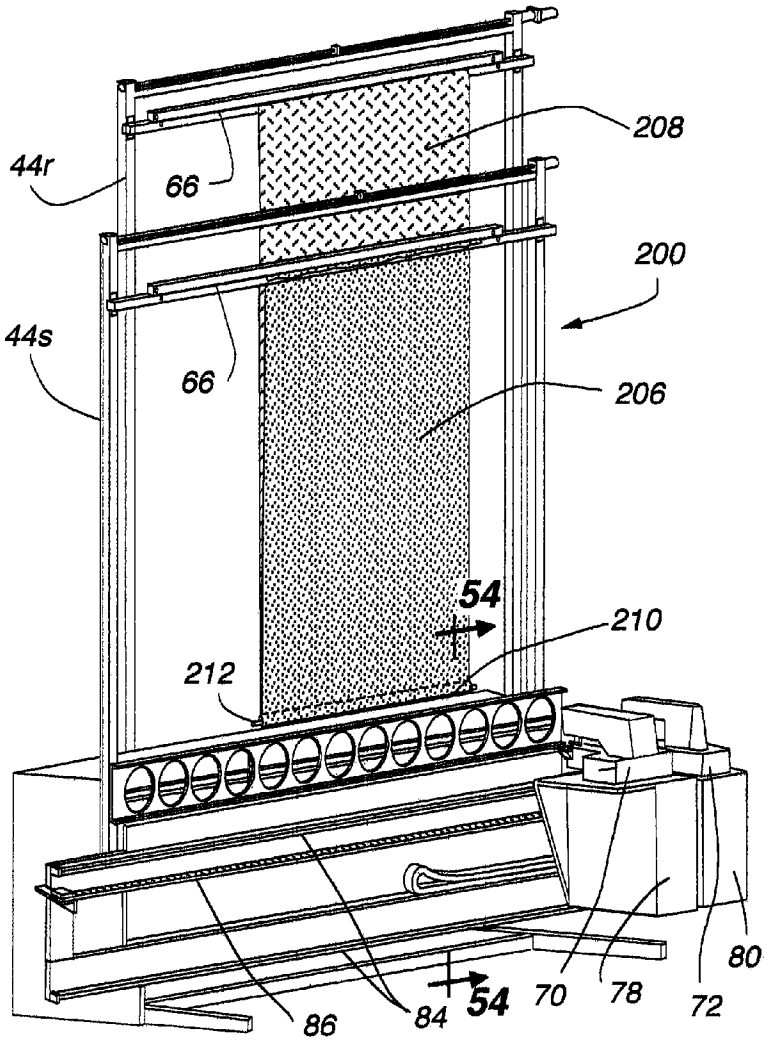
FIG. 46 is an isometric similar to FIG. 45 with the panels of fabric having been elevated by the lift towers prior to processing the fabric panels.

After the top edges of the front 208 and back 206 sheets are attached to the associated upper clamps 66 of the lift racks, the lift racks are elevated as shown in FIG. 46 so the sheets are vertically suspended in abutting face-to-face relationship with each other with the longer front sheet extending above the shorter back sheet. The lower edges of the sheets, of course, are coincident with the weighted bottom rail 212 retaining the sheets in a fully-extended condition and with the bottom edges slightly above the housing 42 of the apparatus.

Figure 55:
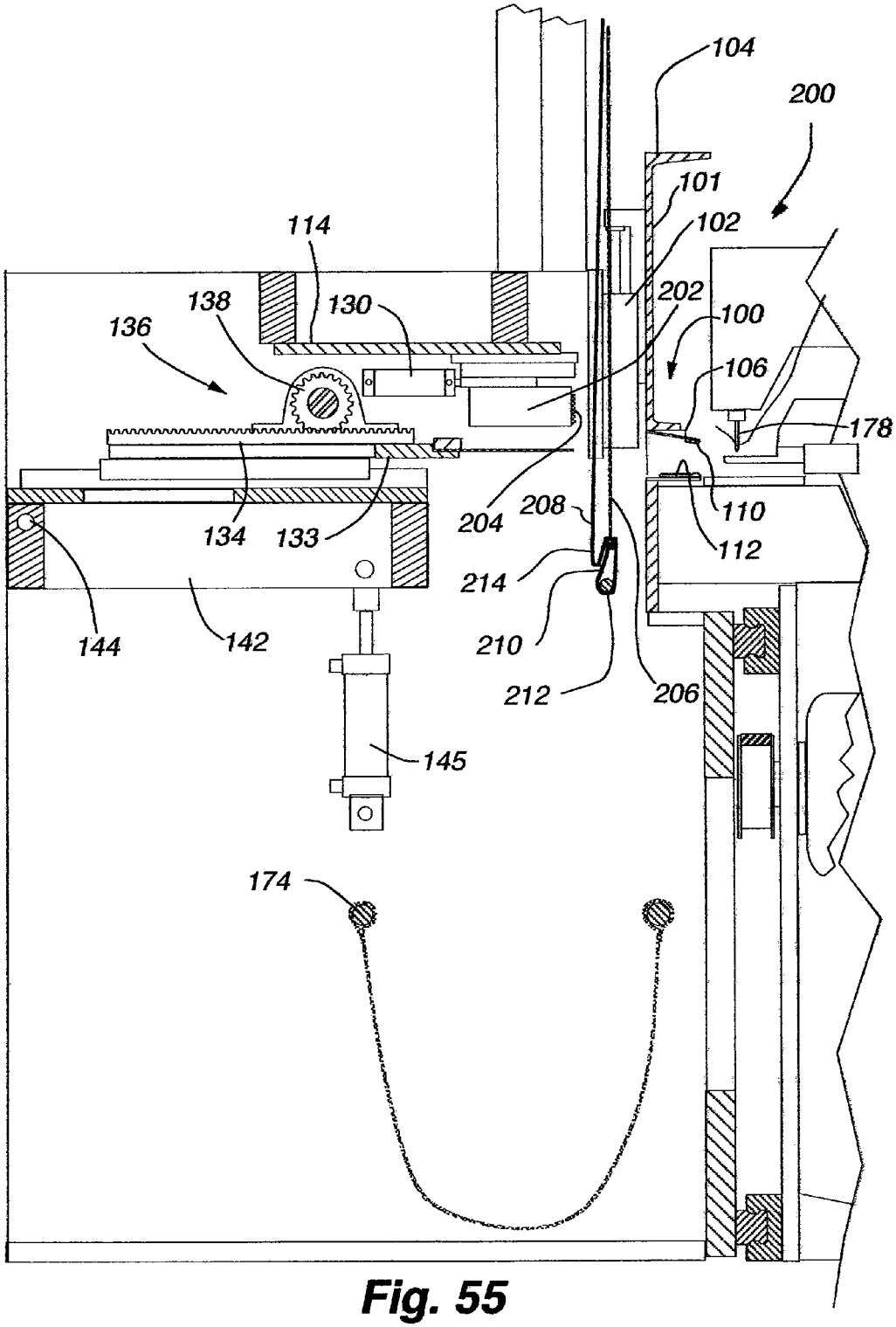
FIG. 55 is an enlarged section taken along line 55-55 of FIG. 47.
Figure 56:
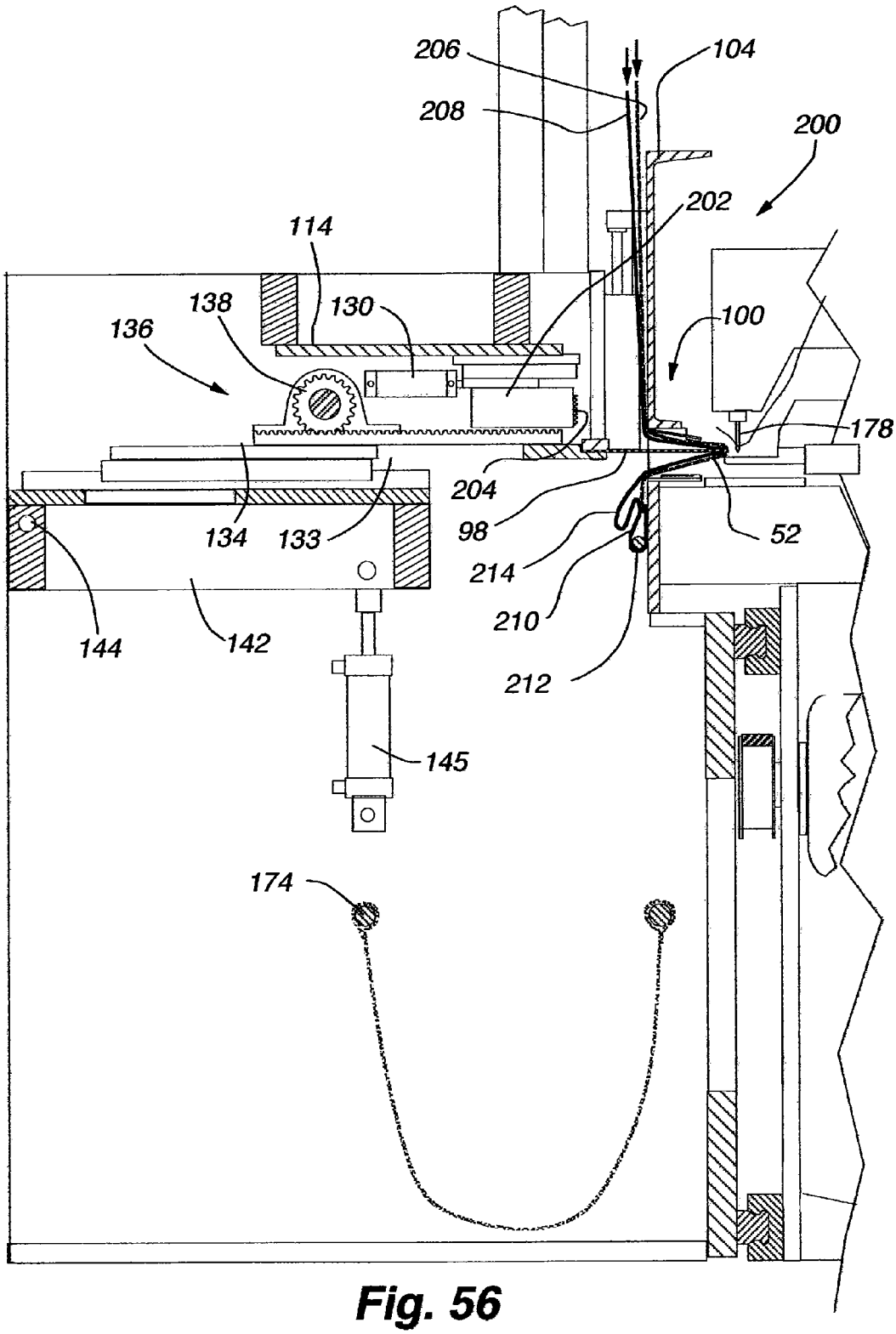
FIG. 56 is an enlarged section taken along line 56-56 of FIG. 48.
Figure 57:
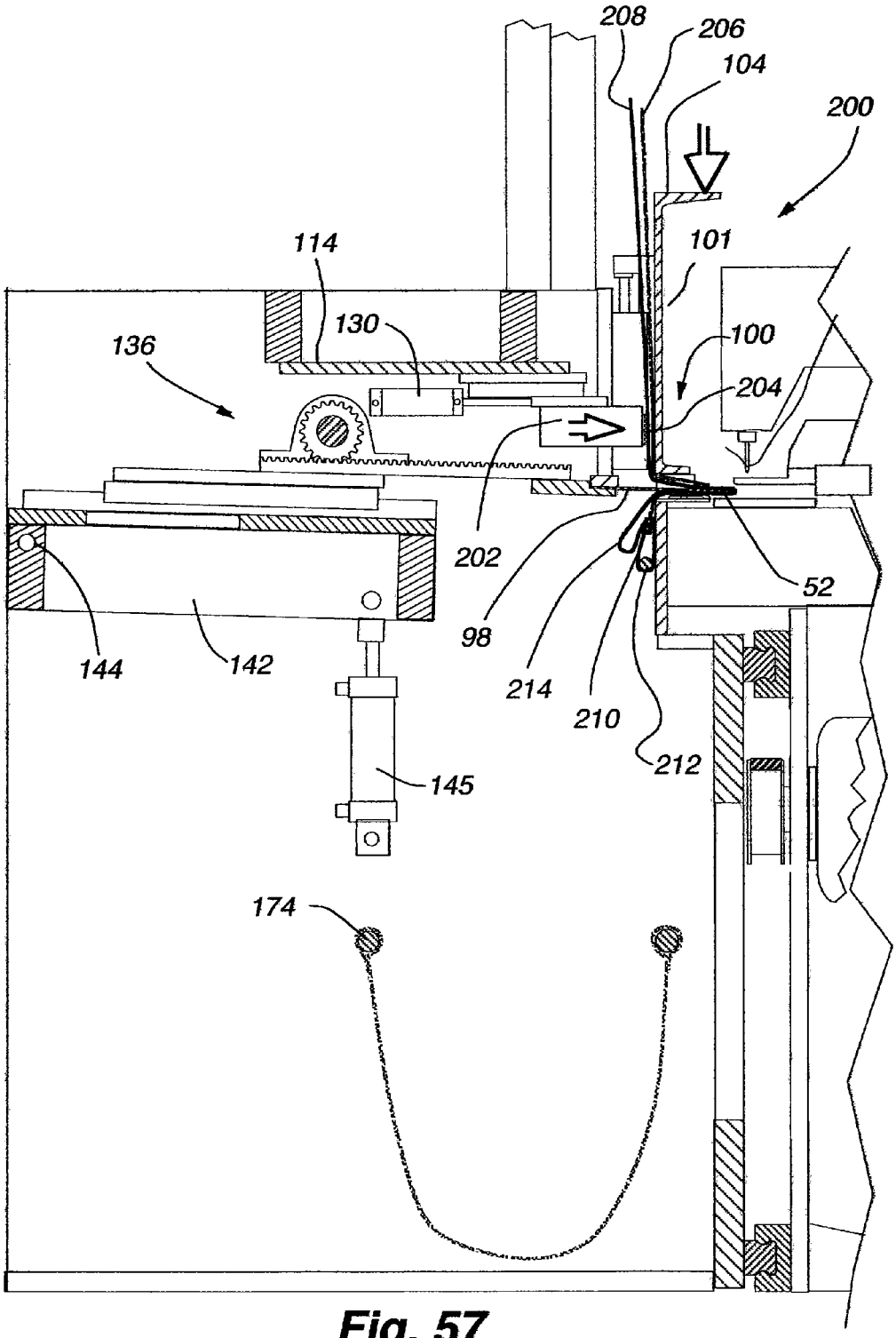
FIG. 57 is a section similar to FIG. 56 with the stabilizing clamp having been energized.

To begin forming the fabric of FIG. 42, the bottom rail at the bottom edges of the front and back sheets of material is dropped below the tucker blade 98 a predetermined amount as shown, for example, in FIG. 55. It will also be appreciated the front sheet 208, which appears on the left in FIG. 5, has been dropped slightly further than the back sheet 206 with the difference in dropped distance being equivalent to the height desired for a hobble 54 that will be formed in the finished fabric. For example, if a hobble is to be four inches in depth from top to bottom, the front sheet will be dropped four inches further than the back sheet so as to form a loop 214 for the first hobble to be formed in the fabric. With the sheets of material positioned as shown in FIG. 55, the tucker blade is advanced as shown in FIG. 56 a predetermined distance so as to form a tuck 52 in the fabric of a predetermined depth. As the tucker blade is being advanced, the upper clamps 66 for both the front and back sheets of material are lowered a corresponding amount to the depth of the tucks while the bottom rail is lifted that same amount so the fabric does not slide around the leading edge 140 of the tucker blade but rather both sheets of fabric are pulled down and up equivalent amounts as the tucker blade forms the horizontal tuck. After the tuck has been formed, the upper jaw 108 of the tucker clamp is lowered by the pneumatic cylinder 102 until the upper jaw clamps the tucked sheets of material and the tucker blade between the upper jaw and the platen 112. After the tuck is secured with the tuck clamp 100, the stabilizing clamp 202 is advanced into engagement with the fabric having the rail 101 as the backing plate by activating the pneumatic cylinder 130. The stabilizing clamp thereby grips the fabric and stabilizes the fabric so there is no movement in the fabric above the tucker blade when the tucker blade is withdrawn as shown in FIG. 58.

Figure 58:
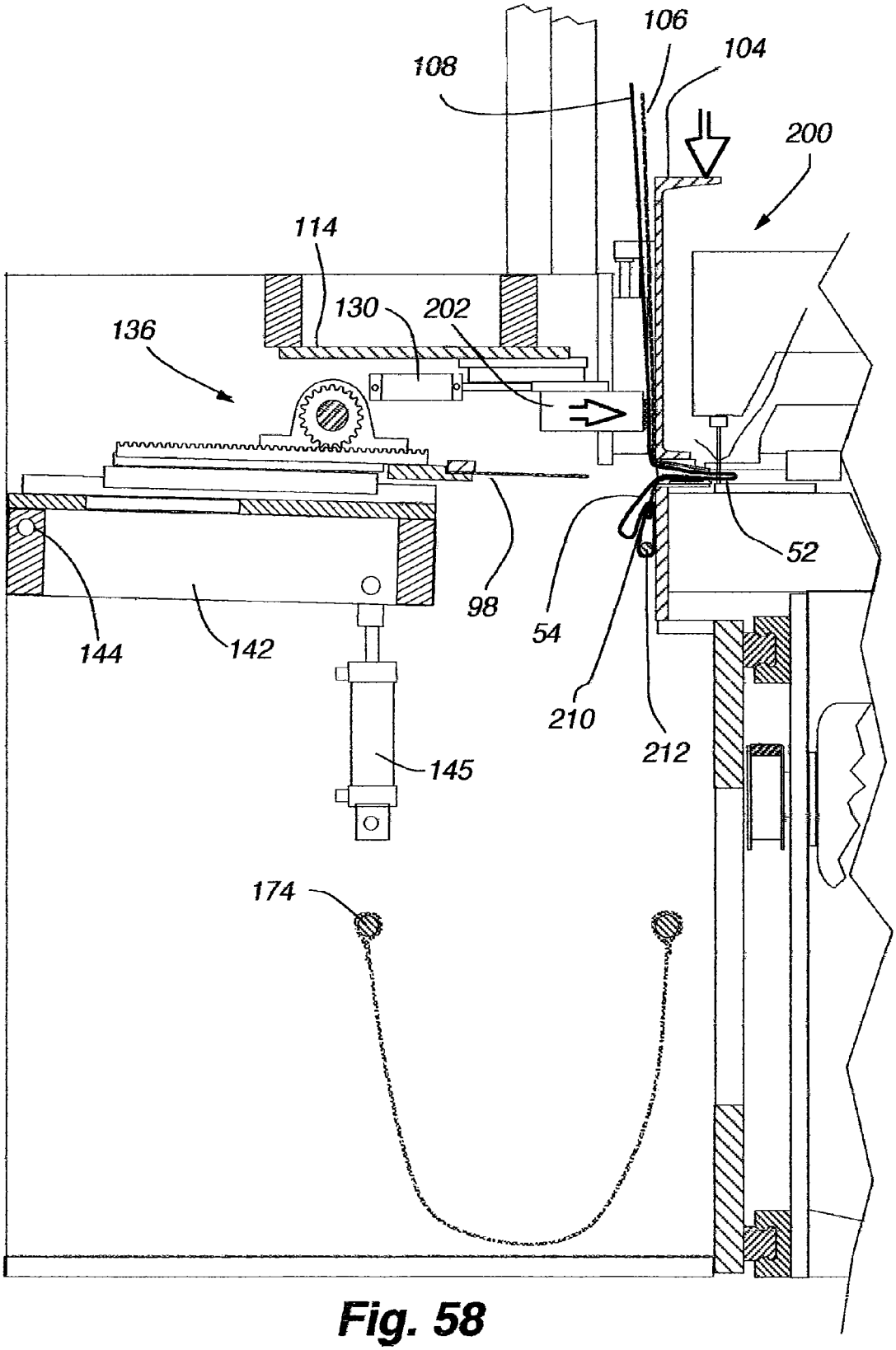
FIG. 58 is a section similar to FIG. 57 with the stitching machine sewing a tuck into the sheets of material.
Figure 59:
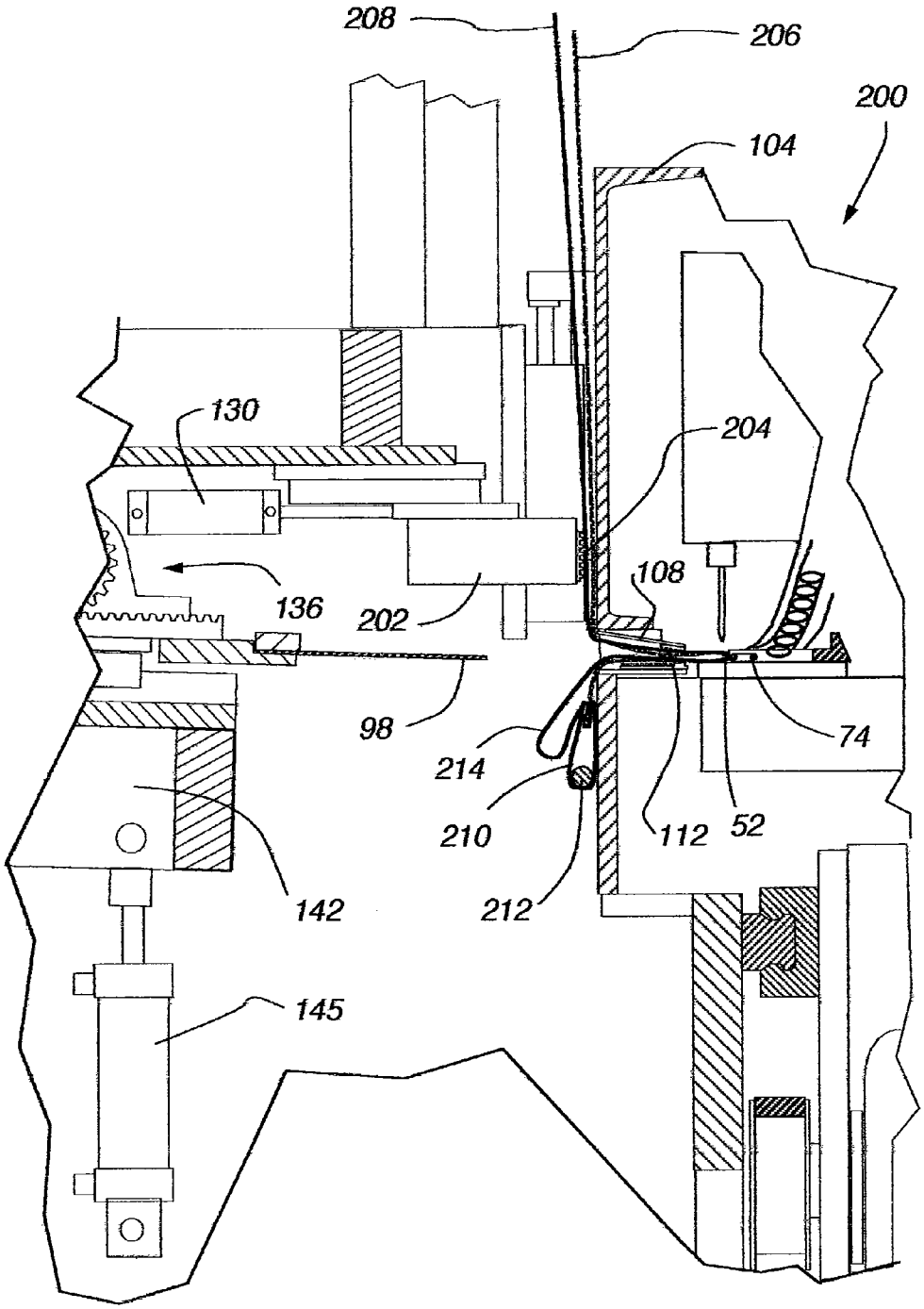
FIG. 59 is a section similar to FIG. 58 with the ring sewing machine positioned to initiate a stitch along a folded edge of the sheets of material.
Figure 60:
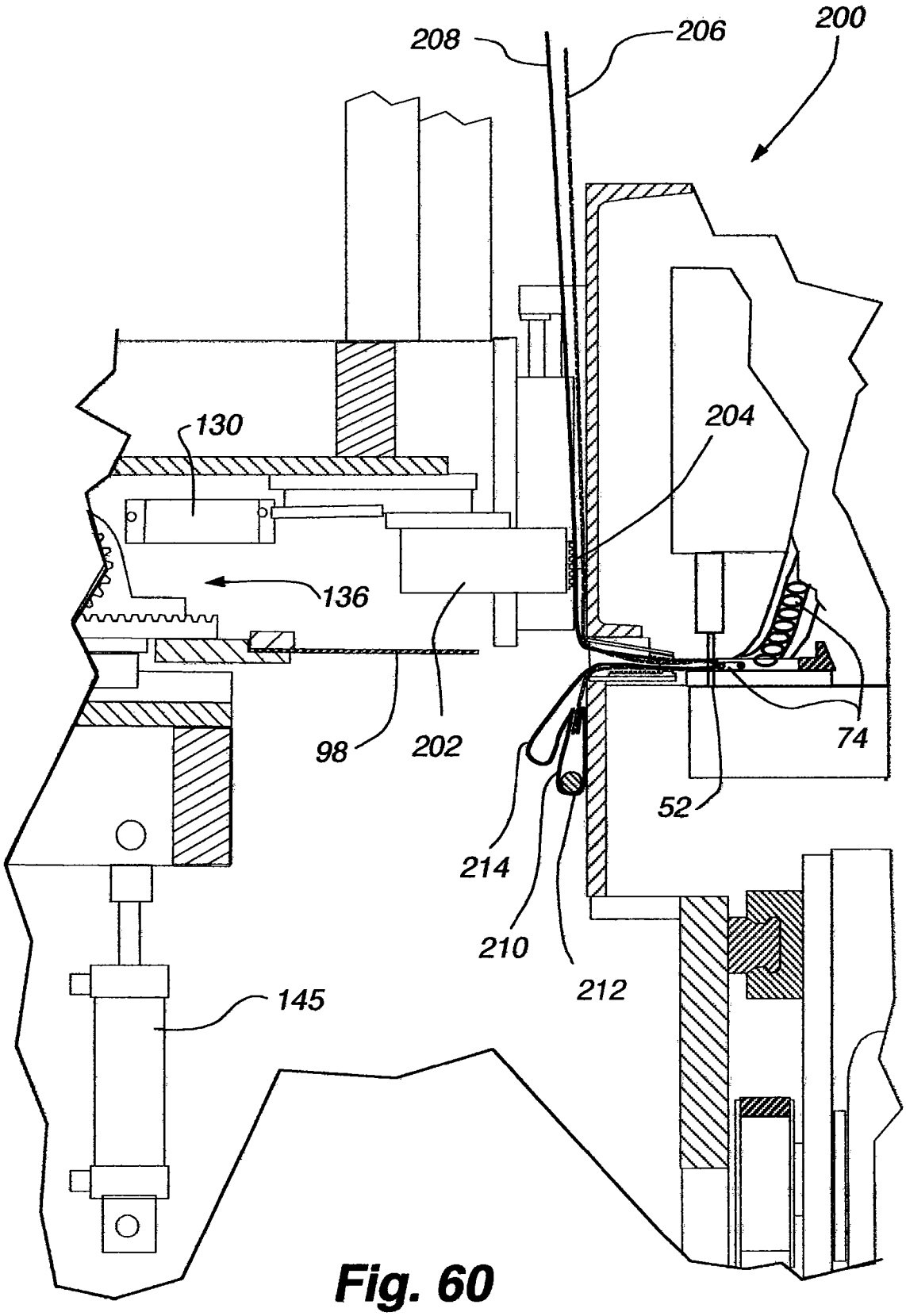
FIG. 60 is an enlarged section taken along line 60-60 of FIG. 49.
Figure 61:
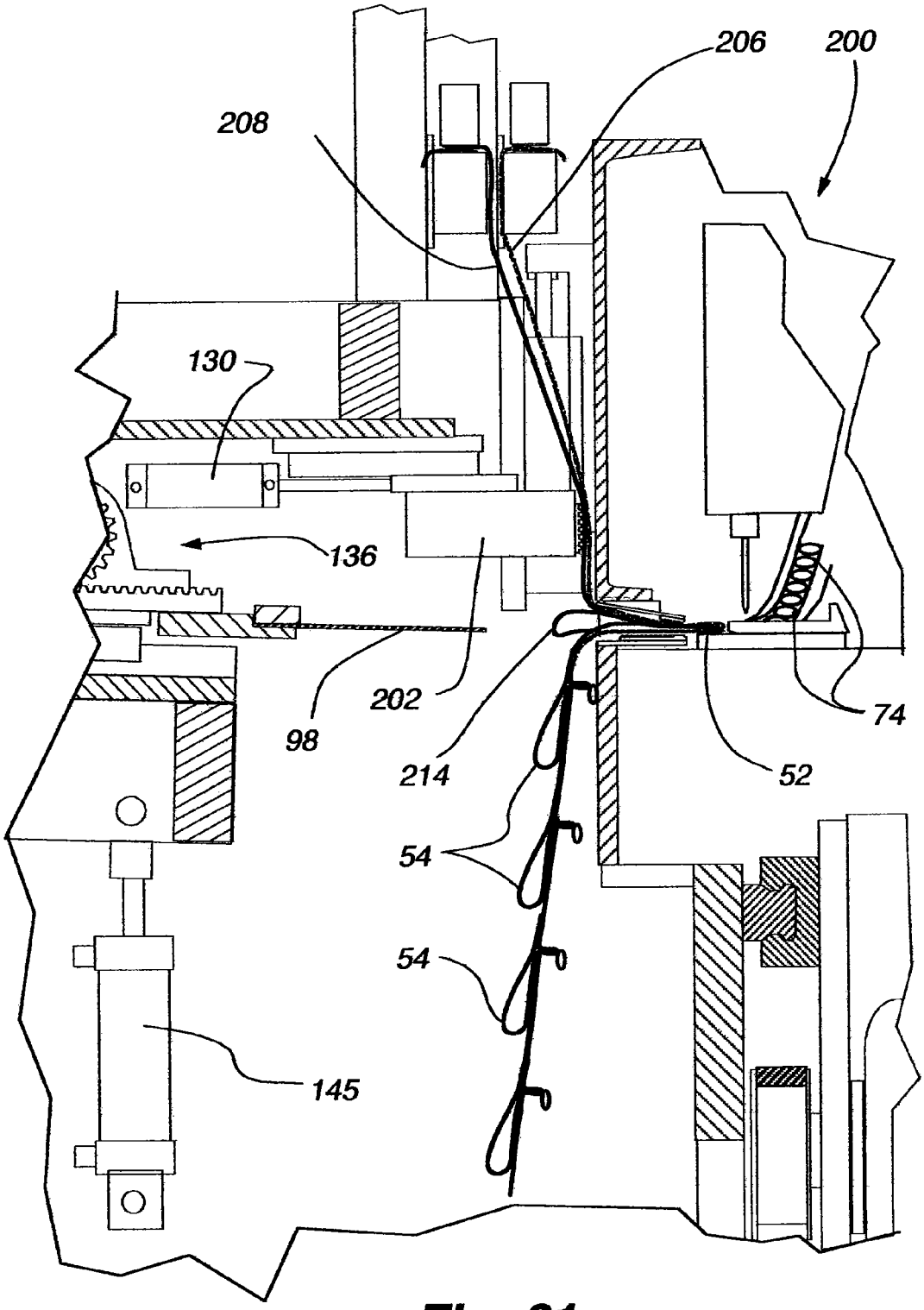
FIG. 61 is an enlarged section taken along line 61-61 of FIG. 60.
Figure 62:
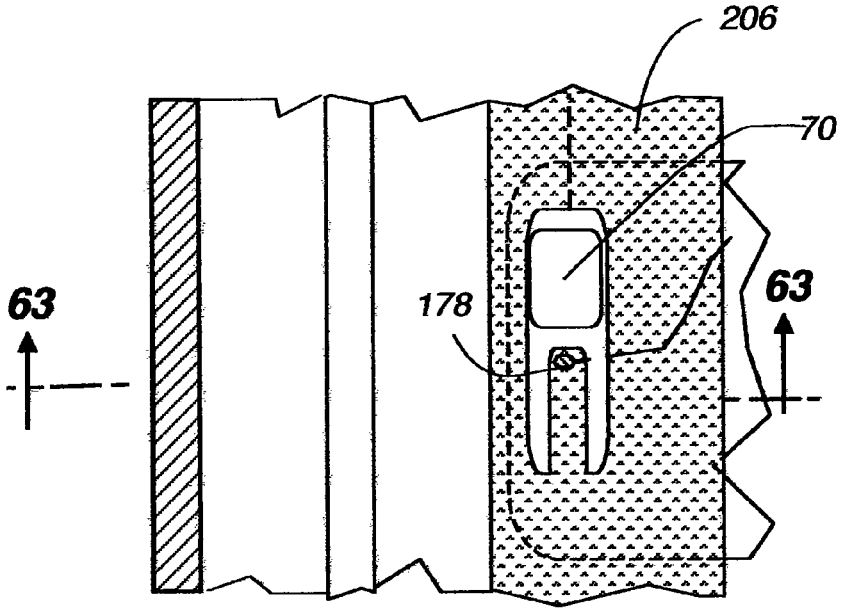
FIG. 62 is an enlarged section taken along line 62-62 of FIG. 58.
Figure 63:
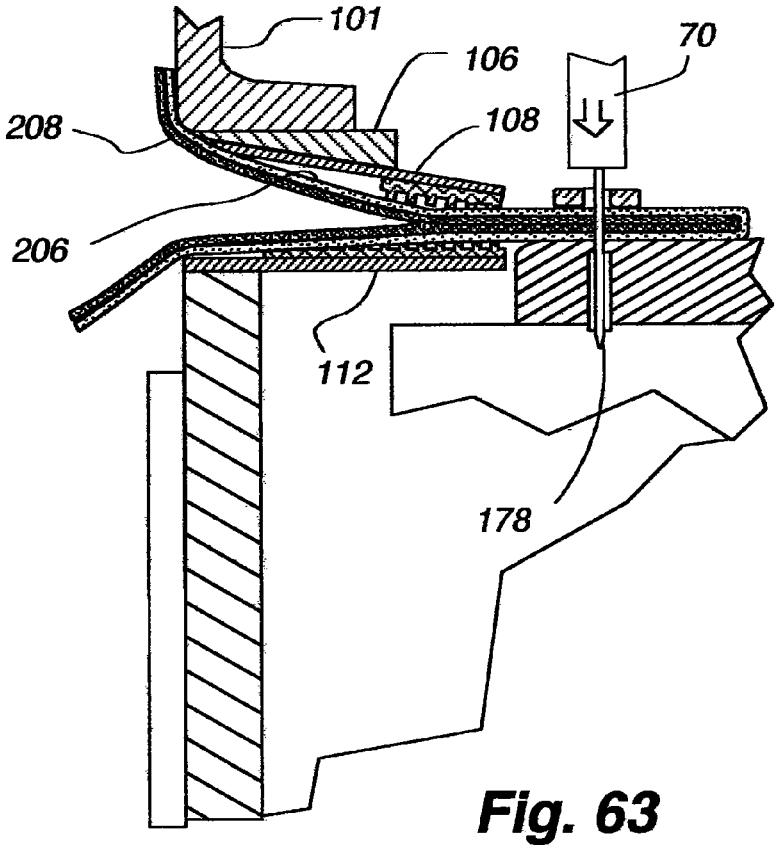
FIG. 63 is a section taken along line 63-63 of FIG. 62.

With the tucker blade 98 withdrawn, as shown in FIG. 58, the stitching sewing machine 70 (FIGS. 62 and 63) commences it traverse along the width of the sheets of material so as to sew a seam in the fabric defining a tuck or tunnel 52 to the right of the seam between the stitching and the folded edge of the sheets of material. After the seam has been sewn across the entire width of the sheets of material, the ring attaching sewing machine 72 is positioned as shown in FIG. 59 above the tuck in the sheets of material so it can initially place a stitch through the folded edge of the sheets of material as shown in FIG. 60 and then after withdrawing the needle 178, the first ring 74, which has been positioned for attachment to the sheets of material, is advanced beneath the needle, as described with the first embodiment, so the needle's next stitch goes through the open center of the ring and by reciprocating the ring back and forth along with the folded edge of the sheets of material in synchronization with reciprocation of the needle, the ring is attached to the folded edge. It should also be appreciated that a hobble or loop 54 has been formed in the front sheet 208 of material during this process, which was initially set up by lowering the front sheet a greater distance than the back sheet 206 prior to the stitching operations.

The above process is repeated as many times as is necessary to complete a fabric 46 of the size desired.

Figure 64:
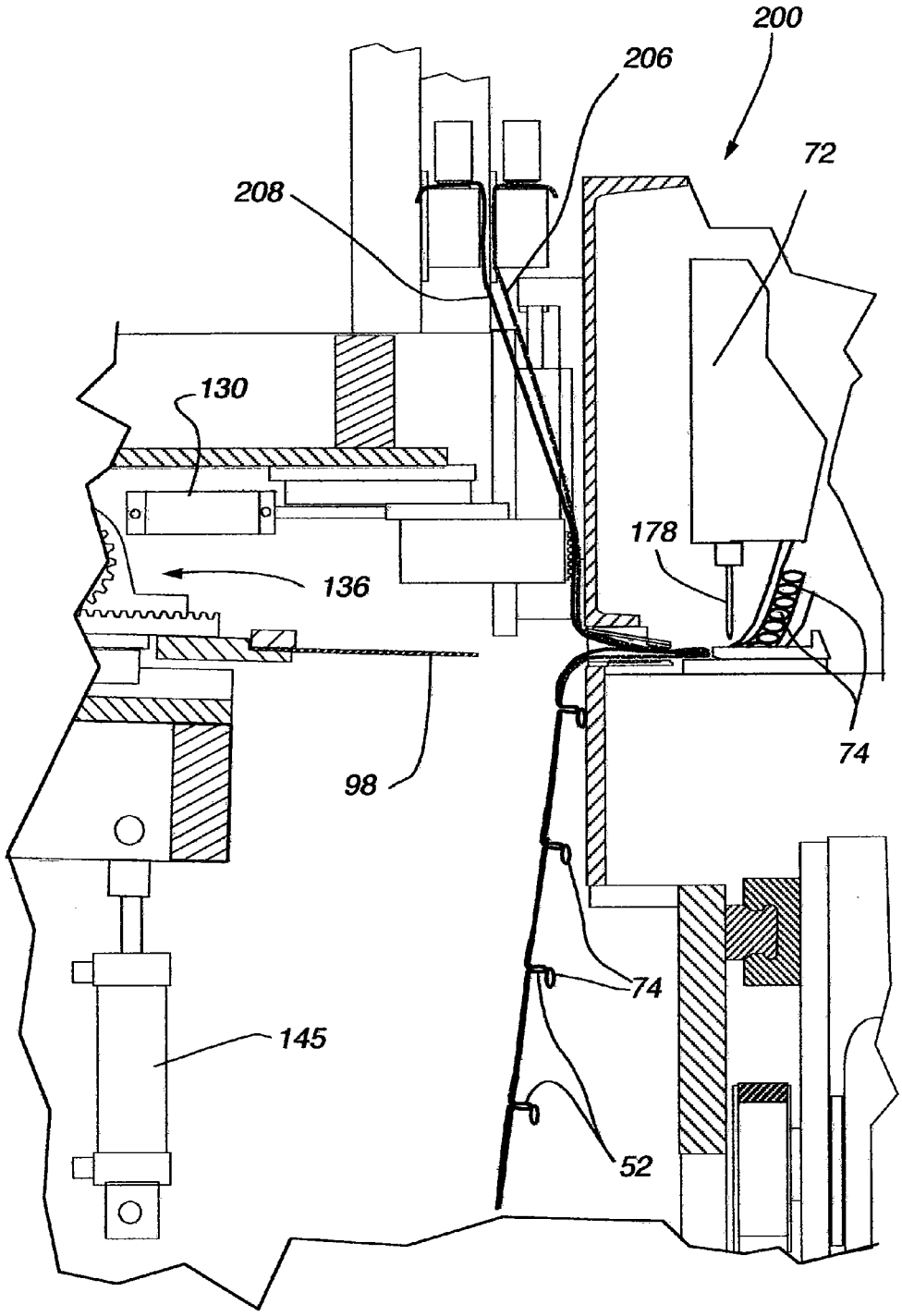
FIG. 64 is a section similar to FIG. 61 where the ring sewing machine is positioned for sewing a ring to sheets of material that do not have a hobble but are merely formed with tucks to which rings are attached.
Figure 65:
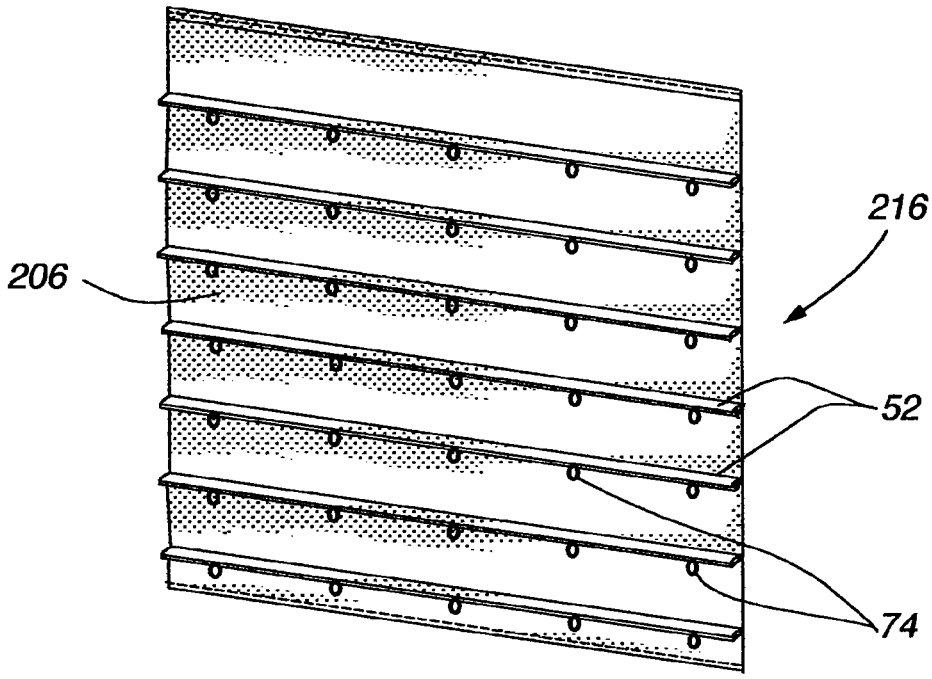
FIG. 65 is a rear isometric showing a panel of fabric material having tucks and rings sewn thereto but with no hobbles.

If it were not desired to form hobbles 54 in the fabric, but rather to simply sew rings 74 to a tuck 52 to form a fabric panel 216 as shown in FIG. 65, when the front 208 and rear 206 sheets of material were first dropped into position, as shown in FIG. 55, the front and rear sheets would be dropped equivalent distances rather than dropping the front sheet a greater distance than the rear sheet. Accordingly, no loops or hobbles would be formed in the front sheet. This is illustrated in FIG. 64 and it will be appreciated the tucks are formed and sewn identically to that previously described as are the rings.

Figure 67:
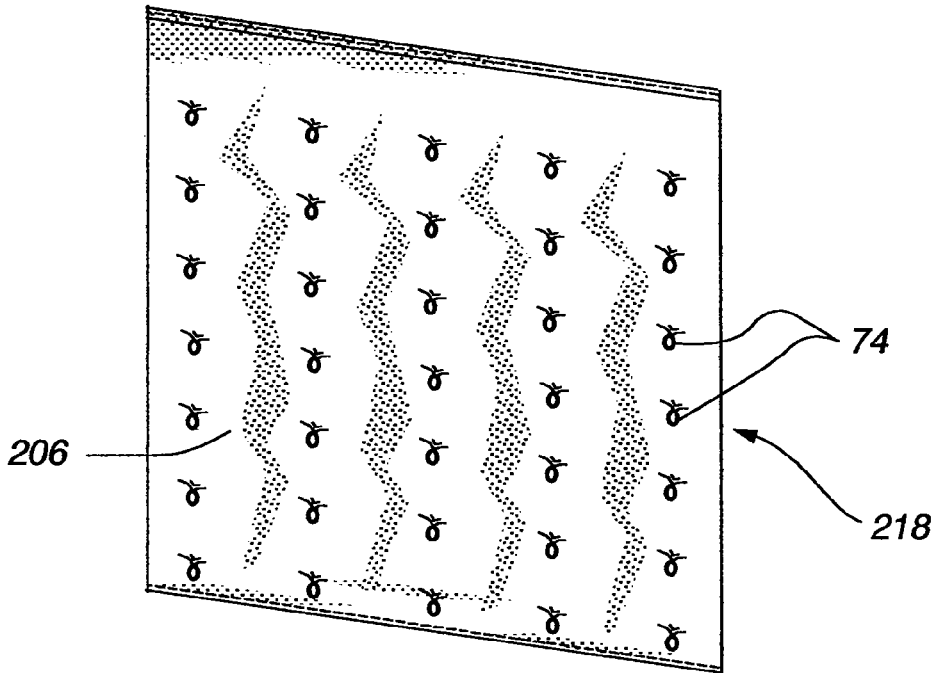
FIG. 67 is a rear isometric showing a panel where rings are sewn to the panel but no tucks or hobbles are formed on the panel.
Figure 66:
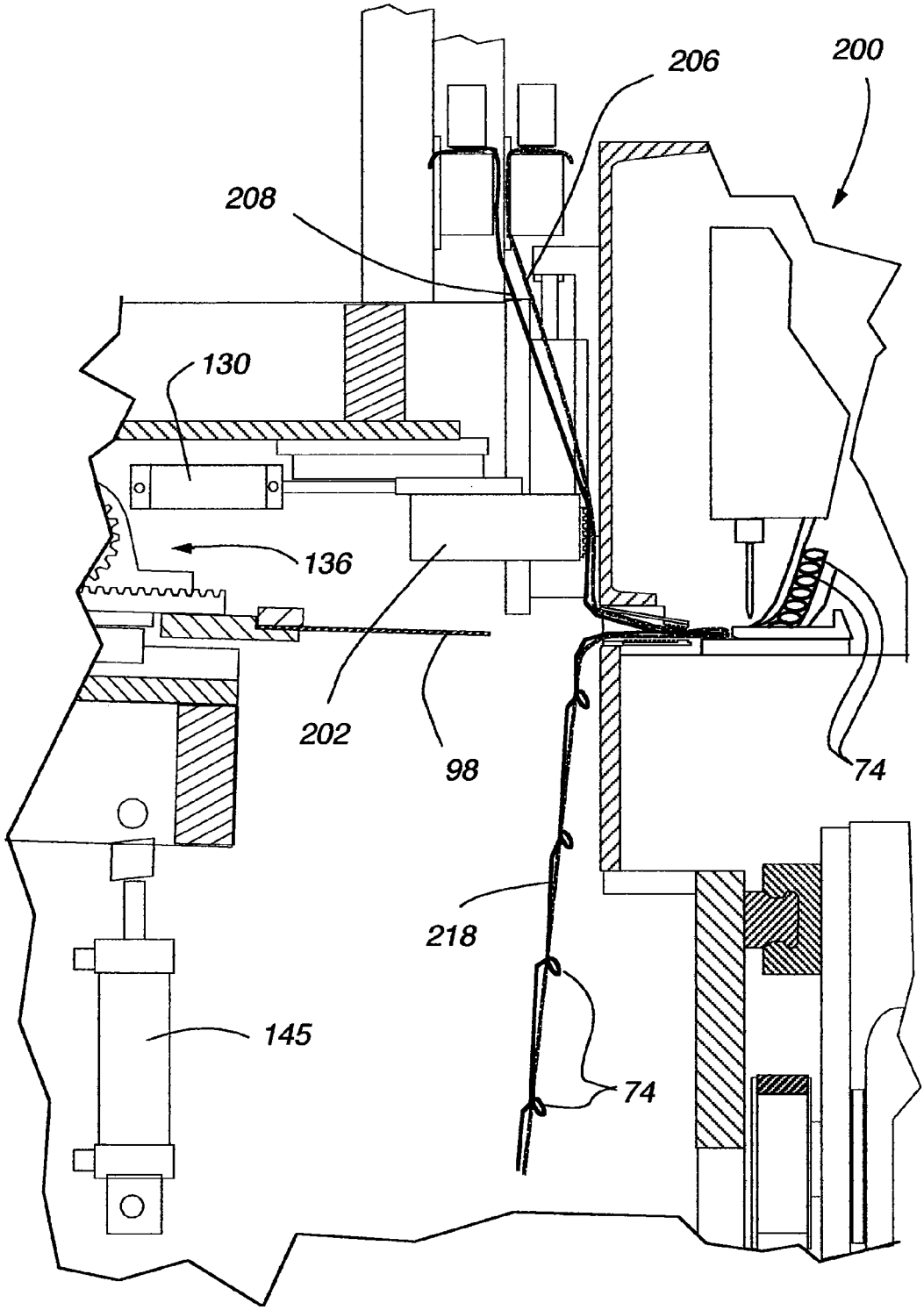
FIG. 66 is a section similar to FIG. 64 wherein the ring sewing machine is positioned to sew a ring to the panels of fabric material where no tuck is formed in the material.

If it were desired to attach rings to a fabric panel 218, as shown in FIG. 67 with no tucks, the tuck would be formed with the tucker blade 98, as previously described, but the stitching previously described as being applied with the first sewing machine 70 would not be applied. Rather, only rings would be attached with the ring attaching machine 72 to the formed but not sewn tuck, as shown in FIG. 66. Accordingly, when the formed but not sewn tuck is released from the tuck clamp 100, it will be appreciated a ring has been attached to the sheets of material, but there is no tuck in the material.

These different forms of fabric which can be made with the second embodiment of the machine of the present invention are similar to those made with the first embodiment with the primary distinction being in the manner in which the hobbles are formed.

Although the present invention has been described with a certain degree of particularity, it is understood the disclosure has been made by way of example and changes in detail or structure may be made without departing from the spirit of the invention as defined in the appended claims.

The invention claimed is:

1. The combination of a fabric and an apparatus for stitching the fabric comprising in combination:

a fabric comprised of two sheets of material;

an apparatus including two lift systems, each lift system including a connector for being releasably attached to a top edge of one of said sheets so as to suspend said sheets in adjacent relationship from said lift systems, each lift system including a drive for raising or lowering the attached sheet independently of the other lift system, a generally horizontally disposed extendable tucker blade for selectively engaging and forming a tuck in said sheets when said tucker blade is extended, and at least one sewing machine mounted for traversing movement across the width of said sheets while stitching said tuck.

2. The combination of claim 1 wherein said lift systems are capable of lowering one of said sheets more than the other of said sheets.

3. The combination of claim 2 wherein each of said sheets has a lower edge secured to the lower edge of the other sheet such that when said one sheet is lowered more than said other sheet a loop is formed in said one sheet.

4. The combination of claim 3 wherein said tucker blade is disposed above the location where said loop is formed so as to establish a tuck in said sheets above said loop whereby when said tuck is stitched by said sewing machine, a hobble is formed in said one sheet.

5. The combination of claim 1 or 4 further including a stabilizing clamp for releasably securing said sheets to said apparatus above said tucker blade.

6. The combination of claim 5 wherein said stabilizing clamp is movable between operative and inoperative positions, said clamp remaining in its inoperative position when said sheets are lowered and said tucker blade is extended and remaining in its operative position when said sewing machine stitches said tuck.

7. The combination of claim 6 further including a second sewing machine mounted for traversing movement across the width of said sheets for attaching rings to said tuck.

8. The combination of a fabric and an apparatus for stitching the fabric comprising in combination:

a fabric comprised of at least one sheet of material, and an apparatus including at least one lift system for supporting the fabric in a substantially vertical orientation and including a mechanism for selectively raising or lowering said fabric in predetermined increments, an elongated tucker blade on one side of said fabric for forming a substantially horizontal elongated tuck in said fabric upon engagement with said fabric, a clamp on the opposite side of said fabric from said tucker blade for clamping a tuck formed in said fabric by said tucker blade, a system for removing said tucker blade from said tuck while it is being clamped and at least one sewing machine for performing sewing operations in said tuck after the removal of said tucker blade from said tuck.

9. The combination of claim 8 wherein said at least one sewing machine forms a stitch in said tuck to hold the tuck together.

10. The combination of a fabric and an apparatus for stitching the fabric comprising in combination:

a fabric comprised of at least one sheet of material, and an apparatus including at least one lift system for supporting the fabric in a substantially vertical orientation and including a mechanism for selectively raising or lowering said fabric in predetermined increments, an elongated tucker blade on one side of said fabric for forming a substantially horizontal elongated tuck in said fabric upon engagement with said fabric, a clamp on the opposite side of said fabric from said tucker blade for clamping a tuck formed in said fabric by said tucker blade, and at least one sewing machine for performing sewing operations in said tuck, said at least one sewing machine forming a stitch in said tuck to hold the tuck together.

11. The combination of a fabric and an apparatus for stitching the fabric comprising in combination:

a fabric comprised of at least one sheet of material, and an apparatus including at least one lift system for supporting the fabric in a substantially vertical orientation and including a mechanism for selectively raising or lowering said fabric in predetermined increments, an elongated tucker blade on one side of said fabric for forming a substantially horizontal elongated tuck in said fabric upon engagement with said fabric, a clamp on the opposite side of said fabric from said tucker blade for clamping a tuck formed in said fabric by said tucker blade, and two sewing machines with one of said sewing machines for stitching said tuck and the other said sewing machine for sewing rings to said tuck at horizontally spaced intervals along the length of said tuck.

12. The combination of a fabric and an apparatus for stitching the fabric comprising in combination:

a fabric comprised of at least one sheet of material, and an apparatus including at least one lift system for supporting the fabric in a substantially vertical orientation and including a mechanism for selectively raising or lowering said fabric in predetermined increments, an elongated tucker blade on one side of said fabric for forming a substantially horizontal elongated tuck in said fabric upon engagement with said fabric, a clamp on the opposite side of said fabric from said tucker blade for clamping a tuck formed in said fabric by said tucker blade, and at least one sewing machine for performing sewing operations in said tuck, wherein said tucker blade has a low friction outer surface and is insertable along with said tuck into said clamp and is removed from said clamp while leaving said tuck in said clamp prior to said at least one sewing machine performing sewing operations on said tuck.

* * * * *